US007393439B2

(12) United States Patent
McHugh et al.

(10) Patent No.: US 7,393,439 B2
(45) **Date of Patent: *Jul. 1, 2008**

(54) INTEGRATED MICROFEATURE WORKPIECE PROCESSING TOOLS WITH REGISTRATION SYSTEMS FOR PADDLE REACTORS

(75) Inventors: Paul R. McHugh, Kalispell, MT (US); Gregory J. Wilson, Kalispell, MT (US); Daniel J. Woodruff, Kalispell, MT (US); Nolan Zimmerman, Kalispell, MT (US); James J. Erickson, Kalispell, MT (US)

(73) Assignee: Semitool, Inc., Kalispell, MT (US)

( * ) Notice: Subject to any disclaimer, the term of this patent is extended or adjusted under 35 U.S.C. 154(b) by 433 days.

This patent is subject to a terminal disclaimer.

(21) Appl. No.: 10/733,807

(22) Filed: Dec. 11, 2003

(65) Prior Publication Data

US 2004/0245094 A1 Dec. 9, 2004

Related U.S. Application Data

(60) Provisional application No. 60/484,603, filed on Jul. 1, 2003, provisional application No. 60/484,604, filed on Jul. 1, 2003, provisional application No. 60/476,786, filed on Jun. 6, 2003.

(51) Int. Cl.
*C25D 17/16* (2006.01)
*C25B 9/18* (2006.01)
*C25C 7/00* (2006.01)

(52) U.S. Cl. ..... 204/273; 204/225; 204/242; 204/267; 204/269; 204/272; 204/275.1; 204/286.1; 204/287

(58) Field of Classification Search ..... 204/242, 204/212, 247.1, 261, 273, 286.1, 225, 267, 204/269, 272, 275.1, 287; 205/123, 157, 205/291
See application file for complete search history.

(56) References Cited

U.S. PATENT DOCUMENTS 3,652,442 A 3/1972 Powers et al.

(Continued)

FOREIGN PATENT DOCUMENTS

EP 0 343 502 A2 11/1989

(Continued)

OTHER PUBLICATIONS

U.S. Appl. No. 60/476,786, Davis et al.

(Continued)

*Primary Examiner*—Roy King
*Assistant Examiner*—Lois Zheng
(74) *Attorney, Agent, or Firm*—Perkins Coie LLP

(57) ABSTRACT

Tools having mounting modules with registration systems are disclosed. The mounting module includes positioning elements for precisely locating a processing chamber and a transport system that moves workpieces to and from the processing chamber. The relative positions between positioning elements of the module are fixed so that the transport system does not need to be recalibrated when the processing chamber is removed and replaced with another processing chamber. The processing chamber includes a paddle device for agitating processing liquid at a process surface of the workpiece. The paddle device, the processing chamber, and electrodes within the processing chamber are configured to reduce the likelihood for electrical shadowing created by the paddles at the surface of the workpiece, and to account for three-dimensional effects on the electrical field as the paddles reciprocate relative to the workpiece.

23 Claims, 17 Drawing Sheets

U.S. PATENT DOCUMENTS 4,428,814 A 1/1984 Chen
4,466,864 A 8/1984 Bacon
4,648,774 A 3/1987 Dorumsgaard et al.
4,749,601 A 6/1988 Hillinger
4,868,575 A * 9/1989 Mok et al. ..... 342/373
4,917,421 A 4/1990 Wightman et al.
4,937,998 A * 7/1990 Goldberg ..... 52/729.5
5,000,827 A 3/1991 Schuster
5,222,310 A 6/1993 Thompson et al.
5,230,743 A 7/1993 Thompson et al.
5,284,554 A 2/1994 Datta et al.
5,312,532 A 5/1994 Andricacos et al.
5,344,491 A 9/1994 Katou
5,344,539 A 9/1994 Shinogi et al.
5,402,807 A 4/1995 Moore et al.
5,421,987 A 6/1995 Tzanavaras et al.
5,431,421 A 7/1995 Thompson et al.
5,476,577 A 12/1995 May et al.
5,486,282 A 1/1996 Datta et al.
5,516,412 A 5/1996 Andricacos et al.
5,531,874 A 7/1996 Brophy
5,536,388 A 7/1996 Dinan et al.
5,543,032 A 8/1996 Datta et al.
5,567,300 A 10/1996 Datta et al.
5,614,076 A 3/1997 Brophy
5,635,157 A 6/1997 Mease et al.
5,683,564 A 11/1997 Reynolds
5,733,024 A 3/1998 Slocum et al.
5,762,751 A 6/1998 Bleck
5,865,984 A 2/1999 Corbin, Jr. et al.
5,925,226 A 7/1999 Hurwitt et al.
6,001,235 A 12/1999 Arken et al.
6,004,440 A 12/1999 Hanson
6,024,856 A 2/2000 Haydu et al.
6,027,631 A 2/2000 Broadbent
6,035,804 A 3/2000 Arami et al.
6,037,790 A 3/2000 Dinan
6,042,712 A 3/2000 Mathieu
6,048,154 A 4/2000 Wylman
6,082,948 A 7/2000 Fishkin et al.
6,103,096 A 8/2000 Datta et al.
6,132,586 A 10/2000 Adams et al.
6,136,163 A 10/2000 Cheung et al.
6,139,703 A 10/2000 Hanson
6,168,695 B1 1/2001 Woodruff
6,181,057 B1 1/2001 Inoue et al.
6,197,182 B1 3/2001 Kaufman et al.
6,214,193 B1 4/2001 Reid
6,228,231 B1 5/2001 Uzoh
6,231,743 B1 5/2001 Etherington
6,251,250 B1 6/2001 Keigler
6,312,522 B1 11/2001 Dinh et al.
6,322,674 B1 11/2001 Berner
6,328,872 B1 12/2001 Talieh
6,379,511 B1 4/2002 Fatula et al.
6,391,114 B1 5/2002 Kirimura et al.
6,454,918 B1 9/2002 Sakaki
6,478,937 B2 11/2002 Olgado et al.
6,482,300 B2 11/2002 Sakaki
6,547,937 B1 4/2003 Oberlitner et al.
6,565,662 B2 5/2003 Amano et al.
6,635,157 B2 10/2003 Dordi et al.
6,660,137 B2 12/2003 Wilson et al.
6,672,820 B1 1/2004 Hanson
6,773,559 B2 8/2004 Woodruff et al.
6,875,333 B2 4/2005 Sakaki et al.
6,921,467 B2 7/2005 Hanson et al.
6,955,747 B2 * 10/2005 Browne et al. ..... 204/273
7,018,517 B2 3/2006 Kurita et al.
2001/0032788 A1 10/2001 Woodruff et al.
2001/0052465 A1 12/2001 Dordi et al.
2002/0000380 A1 1/2002 Graham et al.
2002/0053509 A1 5/2002 Hanson et al.
2002/0088708 A1 7/2002 Sakaki
2003/0038035 A1 2/2003 Wilson et al.
2003/0047337 A1 3/2003 Jimenez
2003/0221953 A1 12/2003 Oberlitner
2004/0007467 A1 1/2004 McHugh et al.
2004/0134774 A1 7/2004 Woodruff et al.
2005/0000817 A1 1/2005 McHugh et al.
2005/0006241 A1 1/2005 McHugh et al.
2005/0034977 A1 * 2/2005 Hanson et al. ..... 204/242
2005/0035046 A1 2/2005 Hanson et al.
2005/0061438 A1 3/2005 Davis et al.
2005/0063798 A1 3/2005 Davis et al.
2005/0145499 A1 7/2005 Kovarsky et al.
2005/0167275 A1 8/2005 Keigler et al.

FOREIGN PATENT DOCUMENTS

EP 0 726 698 A2 8/1996
EP 0881673 12/1998
JP 62-297494 12/1987
JP 62-297495 12/1987
JP 1-120827 5/1989
JP 5-175158 7/1993
JP 06-260468 9/1994
JP 7-211724 8/1995
JP 7-284738 10/1995
JP 09089067 3/1997
JP 10-172974 6/1998
JP 11-092993 4/1999
JP 2000-17480 1/2000
JP 2001-64795 3/2001
WO WO-99/25004 5/1999
WO WO-01/00173 1/2001
WO WO 01/50505 * 7/2001
WO WO-01/50505 A3 7/2001
WO WO-2004/110698 A2 12/2004
WO WO-2005/042804 A2 5/2005

OTHER PUBLICATIONS

U.S. Appl. No. 60/476,881, Hanson.
U.S. Appl. No. 60/484,603, Wilson et al.
U.S. Appl. No. 60/484,604, Wilson et al.
Wu, Z.L. et al., "Methods for Characterization of Mass Transfer Boundary layer in an industrial Semiconductor Wafer Plating Cell," Abs. 165, 205th Meeting, © The Electrochemical Society, Inc., 2004 (1 Page).
Tacken, R.A. et al., "Applications of Magnetoelectrolysis", Journal of Applied Electrochemistry, 1995 (no month), vol. 25, pp. 1-5.
International Search Report for PCT/USO4/17670; Mailed Jun. 22, 2006; Applicant: Semitool, Inc. (19 pages).
Declaration of Thomas L. Ritzdorf; 1 pg; Jun. 7, 2007.

* cited by examiner

INTEGRATED MICROFEATURE WORKPIECE PROCESSING TOOLS WITH REGISTRATION SYSTEMS FOR PADDLE REACTORS

CROSS-REFERENCE TO RELATED APPLICATIONS

The present application claims priority to pending U.S. Provisional Application No. 60/484,603, filed Jul. 1, 2003; pending U.S. Provisional Application No. 60/484,604, filed Jul. 1, 2003; and pending U.S. Provisional Application No. 60/476,786, filed Jun. 6, 2003, all of which are incorporated herein in their entireties by reference.

TECHNICAL FIELD

The present invention is directed toward microfeature workpiece processing tools having registration systems for locating transport devices and reactors, including reactors having multiple electrodes and/or enclosed reciprocating paddles.

BACKGROUND

Microdevices are manufactured by depositing and working several layers of materials on a single substrate to produce a large number of individual devices. For example, layers of photoresist, conductive materials, and dielectric materials are deposited, patterned, developed, etched, planarized, and otherwise manipulated to form features in and/or on a substrate. The features are arranged to form integrated circuits, microfluidic systems, and other structures.

Wet chemical processes are commonly used to form features on microfeature workpieces. Wet chemical processes are generally performed in wet chemical processing tools that have a plurality of individual processing chambers for cleaning, etching, electrochemically depositing materials, or performing combinations of these processes. Each chamber typically includes a vessel in which wet processing fluids are received, and a workpiece support (e.g., a lift-rotate unit) that holds the workpiece in the vessel during processing. A robot moves the workpiece into and out of the chambers.

One concern with integrated wet chemical processing tools is that the processing chambers must be maintained and/or repaired periodically. In electrochemical deposition chambers, for example, consumable electrodes degrade over time because the reaction between the electrodes and the electrolytic solution decomposes the electrodes. The shapes of the consumable electrodes accordingly change, causing variations in the electrical field. As a result, consumable electrodes must be replaced periodically to maintain the desired deposition parameters across the workpiece. The electrical contacts that contact the workpiece also may need to be cleaned or replaced periodically. To maintain or repair electrochemical deposition chambers, they are typically removed from the tool and replaced with an extra chamber.

One problem with repairing or maintaining existing wet chemical processing chambers is that the tool must be taken offline for an extended period of time to remove and replace the processing chamber. When the processing chamber is removed from the tool, a pre-maintained processing chamber is mounted in its place. The robot and the lift-rotate unit are then recalibrated to operate with the new processing chamber. Recalibrating the robot and the lift-rotate unit is a time-consuming process that increases the downtime for repairing or maintaining processing chambers. As a result, when only one processing chamber of the tool does not meet specifications, it is often more efficient to continue operating the tool without stopping to repair the one processing chamber until more processing chambers do not meet the performance specifications. The loss of throughput of a single processing chamber, therefore, is not as severe as the loss of throughput caused by taking the tool offline to repair or maintain a single one of the processing chambers.

The practice of operating the tool until at least two processing chambers do not meet specifications severely impacts the throughput of the tool. For example, if the tool is not repaired or maintained until at least two or three processing chambers are out of specification, then the tool operates at only a fraction of its full capacity for a period of time before it is taken offline for maintenance. This increases the operating costs of the tool because the throughput not only suffers while the tool is offline to replace the wet processing chambers and recalibrate the robot, but the throughput is also reduced while the tool is online because it operates at only a fraction of its full capacity. Moreover, as the feature sizes of the processed workpiece decrease, the electrochemical deposition chambers must consistently meet much higher performance specifications. This causes the processing chambers to fall out of specification sooner, which results in shutting down the tool more frequently. Therefore, the downtime associated with repairing and/or maintaining electrochemical deposition chambers and other types of wet chemical processing chambers is significantly increasing the cost of operating wet chemical processing tools.

The electrochemical deposition chambers housed in the tool may also suffer from several drawbacks. For example, during electrolytic processing in these chambers, a diffusion layer develops at the surface of the workpiece in contact with an electrolytic liquid. The concentration of the material applied to or removed from the workpiece varies over the thickness of the diffusion layer. In many cases, it is desirable to reduce the thickness of the diffusion layer so as to allow an increase in the speed with which material is added to or removed from the workpiece. In other cases, it is desirable to otherwise control the material transfer at the surface of the workpiece, for example, to control the composition of an alloy deposited on the surface, or to more uniformly deposit materials in surface recesses having different aspect ratios.

One approach to reducing the diffusion layer thickness is to increase the flow velocity of the electrolyte at the surface of the workpiece. For example, some vessels include paddles that translate or rotate adjacent to the workpiece to create a high speed, agitated flow at the surface of the workpiece. In one particular arrangement, the workpiece is spaced apart from an anode by a first distance along a first axis (generally normal to the surface of the workpiece) during processing. A paddle having a height of about 25% of the first distance along the first axis oscillates between the workpiece in the anode along a second axis transverse to the first axis. In other arrangements, the paddle rotates relative to the workpiece. In still further arrangements, fluid jets are directed at the workpiece to agitate the flow at the workpiece surface.

The foregoing arrangements suffer from several drawbacks. For example, it is often difficult even with one or more paddles or fluid jets, to achieve the flow velocities necessary to significantly reduce the diffusion layer thickness at the surface of the workpiece. Furthermore, when a paddle is used to agitate the flow adjacent to the microfeature workpiece, it can create "shadows" in the electrical field within the electrolyte, causing undesirable nonuniformities in the deposition or removal of material from the microfeature workpiece. Still further, a potential drawback associated with rotating paddles is that they may be unable to accurately control radial variations in the material application/removal process, because the speed of the paddle relative to the workpiece varies as a function of the radius and has a singularity at the center of the workpiece.

The reactors in which such paddles are positioned may also suffer from several drawbacks. For example, the electrode in the reactor may not apply or remove material from the workpiece in a spatially uniform manner, causing some areas of the workpiece to gain or lose material at a greater rate than others. Existing devices are also not configured to transfer material to and/or from different types of workpieces without requiring lengthy, unproductive time intervals between processing periods, during which the devices must be reconfigured (for example, by moving the electrode and/or a shield to adjust the electric field within the electrolyte). Another drawback is that the paddles can disturb the uniformity of the electric field created by the electrode, which further affects the uniformity with which material is applied to or removed from the workpiece. Still another drawback with the foregoing arrangements is that the vessel may also include a magnet positioned proximate to the workpiece to control the magnetic orientation of material applied to the workpiece. When the electrode is removed from the vessel for servicing or replacement, it has been difficult to do so without interfering with and/or damaging the magnet.

SUMMARY

The present invention is a tool that includes a processing chamber having a paddle device, a transport system for moving workpieces to and from the processing chamber, and a registration system for locating the processing chamber and the transport system relative to each other. The tool includes a mounting module having positioning elements and attachment elements for engaging the chamber and the transport system. The positioning elements maintain their relative positions so that the transport system does not need to be recalibrated when the processing chamber is removed and replaced with another processing chamber.

In a particularly useful embodiment of the tool, the mounting module includes a deck that has a rigid outer member, a rigid interior member, and bracing between the outer member and the interior member. The processing chamber is then attached to the deck. The module further includes a platform that has positioning elements for locating the transport mechanism.

In further useful embodiments, the paddle device in the processing chamber is positioned within a paddle chamber, with tight clearances around the paddle device to increase the fluid agitation, and therefore enhance mass transfer effects at the surface of the workpiece. The paddle device can include multiple paddles and can reciprocate through a stroke that changes position over time to reduce the likelihood for electrically shadowing the workpiece. Multiple electrodes (e.g., including a thieving electrode) provide spatial and temporal control over the current density at the surface of the workpiece. An electric field control element can be positioned between electrodes of the chamber and the process location to circumferentially vary the electric current density in the processing fluid at different parts of the process location, thereby counteracting potential three-dimensional effects created by the paddles as they reciprocate relative to the workpiece.

DETAILED DESCRIPTION

As used herein, the terms "microfeature workpiece" or "workpiece" refer to substrates on and/or in which microelectronic devices are integrally formed. Typical microdevices include microelectronic circuits or components, thin-film recording heads, data storage elements, microfluidic devices, and other products. Micromachines or micromechanical devices are included within this definition because they are manufactured using much of the same technology that is used in the fabrication of integrated circuits. The substrates can be semiconductive pieces (e.g., doped silicon wafers or gallium arsenide wafers), nonconductive pieces (e.g., various ceramic substrates), or conductive pieces. In some cases, the workpieces are generally round and in other cases, the workpieces have other shapes, including rectilinear shapes.

Several embodiments of integrated tools for wet chemical processing of microfeature workpieces are described in the context of depositing metals or electrophoretic resist in or on structures of a workpiece. The integrated tools in accordance with the invention, however, can also be used in etching, rinsing or other types of wet chemical processes in the fabrication of microfeatures in and/or on semiconductor substrates or other types of workpieces. Several examples of tools and chambers in accordance with the invention are set forth in FIGS. 1-19F and the following text to provide a thorough understanding of particular embodiments of the invention. The description is divided into the following sections: (A) Embodiments of Integrated Tools With Mounting Modules; (B) Embodiments of Dimensionally Stable Mounting Modules; (C) Embodiments of Reactors Having Multiple Electrodes and Enclosed Paddle Devices; (D) Embodiments of Reactors Having Electric Field Control Elements to Circumferentially Vary an Electric Field; (E) Embodiments of Paddles for Paddle Chambers; and (F) Embodiments of Reactors Having Paddles and Reciprocation Schedules to Reduce Electric Field Shielding. A person skilled in the art will understand, however, that the invention may have additional embodiments, and that the invention may be practiced without several of the details of the embodiments shown in FIGS. 1-19F.

A. Embodiments of Integrated Tools with Mounting Modules

Figure 1:
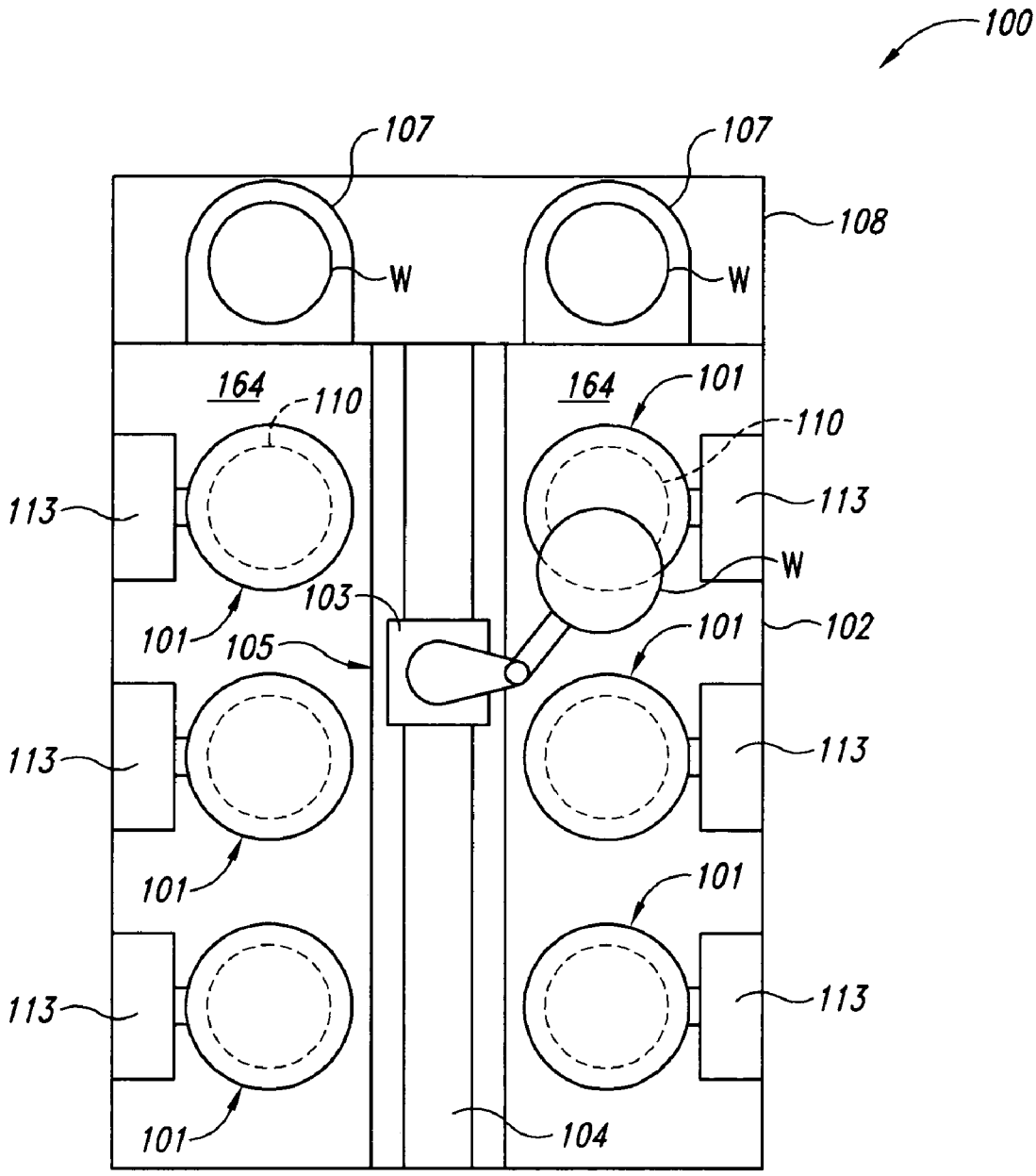
FIG. 1 is a schematic top plan view of a wet chemical processing tool in accordance with an embodiment of the invention.

FIG. 1 schematically illustrates an integrated tool 100 that can perform one or more wet chemical processes. The tool 100 includes a housing or cabinet 102 that encloses a deck 164, a plurality of wet chemical processing stations 101, and a transport system 105. Each processing station 101 includes a vessel, chamber, or reactor 110 and a workpiece support (for example, a lift-rotate unit) 113 for transferring microfeature workpieces W into and out of the reactor 110. The stations 101 can include rinse/dry chambers, cleaning capsules, etching capsules, electrochemical deposition chambers, or other types of wet chemical processing vessels. The transport system 105 includes a linear track 104 and a robot 103 that moves along the track 104 to transport individual workpieces W within the tool 100. The integrated tool 100 further includes a workpiece load/unload unit 108 having a plurality of containers 107 for holding the workpieces W. In operation, the robot 103 transports workpieces W to/from the containers 107 and the processing stations 101 according to a predetermined workflow schedule within the tool 100.

Figure 2A:
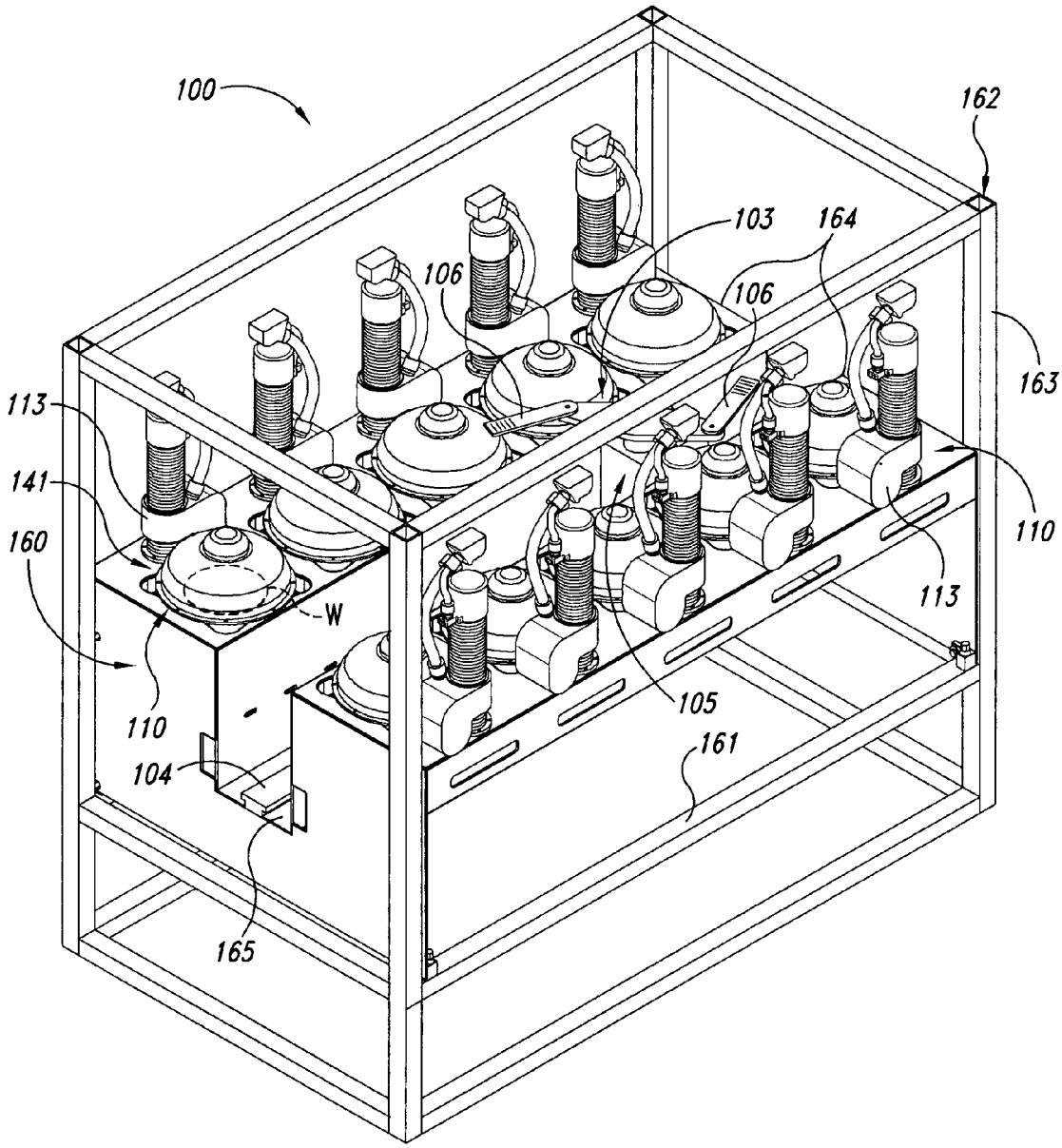
FIG. 2A is an isometric view illustrating a portion of a wet chemical processing tool in accordance with an embodiment of the invention.

FIG. 2A is an isometric view showing a portion of an integrated tool 100 in accordance with an embodiment of the invention. The integrated tool 100 includes a frame 162, a dimensionally stable mounting module 160 mounted to the frame 162, a plurality of wet chemical processing chambers 110, and a plurality of workpiece supports 113. The tool 100 can also include a transport system 105. The mounting module 160 carries the processing chambers 110, the workpiece supports 113, and the transport system 105.

The frame 162 has a plurality of posts 163 and cross-bars 161 that are welded together in a manner known in the art. A plurality of outer panels and doors (not shown in FIG. 2A) are generally attached to the frame 162 to form an enclosed cabinet 102 (FIG. 1). The mounting module 160 is at least partially housed within the frame 162. In one embodiment, the mounting module 160 is carried by the cross-bars 161 of the frame 162, but the mounting module 160 can alternatively stand directly on the floor of the facility or other structures.

The mounting module 160 is a rigid, stable structure that maintains the relative positions between the wet chemical processing chambers 110, the workpiece supports 113, and the transport system 105. One aspect of the mounting module 160 is that it is much more rigid and has a significantly greater structural integrity compared to the frame 162 so that the relative positions between the wet chemical processing chambers 110, the workpiece supports 113, and the transport system 105 do not change over time. Another aspect of the mounting module 160 is that it includes a dimensionally stable deck 164 with positioning elements at precise locations for positioning the processing chambers 110 and the workpiece supports 113 at known locations on the deck 164. In one embodiment (not shown), the transport system 105 is mounted directly to the deck 164. In an arrangement shown in FIG. 2A, the mounting module 160 also has a dimensionally stable platform 165 and the transport system 105 is mounted to the platform 165. The deck 164 and the platform 165 are fixedly positioned relative to each other so that positioning elements on the deck 164 and positioning elements on the platform 165 do not move relative to each other. The mounting module 160 accordingly provides a system in which wet chemical processing chambers 110 and workpiece supports 113 can be removed and replaced with interchangeable components in a manner that accurately positions the replacement components at precise locations on the deck 164.

The tool 100 is particularly suitable for applications that have demanding specifications which require frequent maintenance of the wet chemical processing chambers 110, the workpiece support 113, or the transport system 105. A wet chemical processing chamber 110 can be repaired or maintained by simply detaching the chamber from the processing deck 164 and replacing the chamber 110 with an interchangeable chamber having mounting hardware configured to interface with the positioning elements on the deck 164. Because the mounting module 160 is dimensionally stable and the mounting hardware of the replacement processing chamber 110 interfaces with the deck 164, the chambers 110 can be interchanged on the deck 164 without having to recalibrate the transport system 105. This is expected to significantly reduce the downtime associated with repairing or maintaining the processing chambers 110 so that the tool 100 can maintain a high throughput in applications that have stringent performance specifications.

Figure 2B:
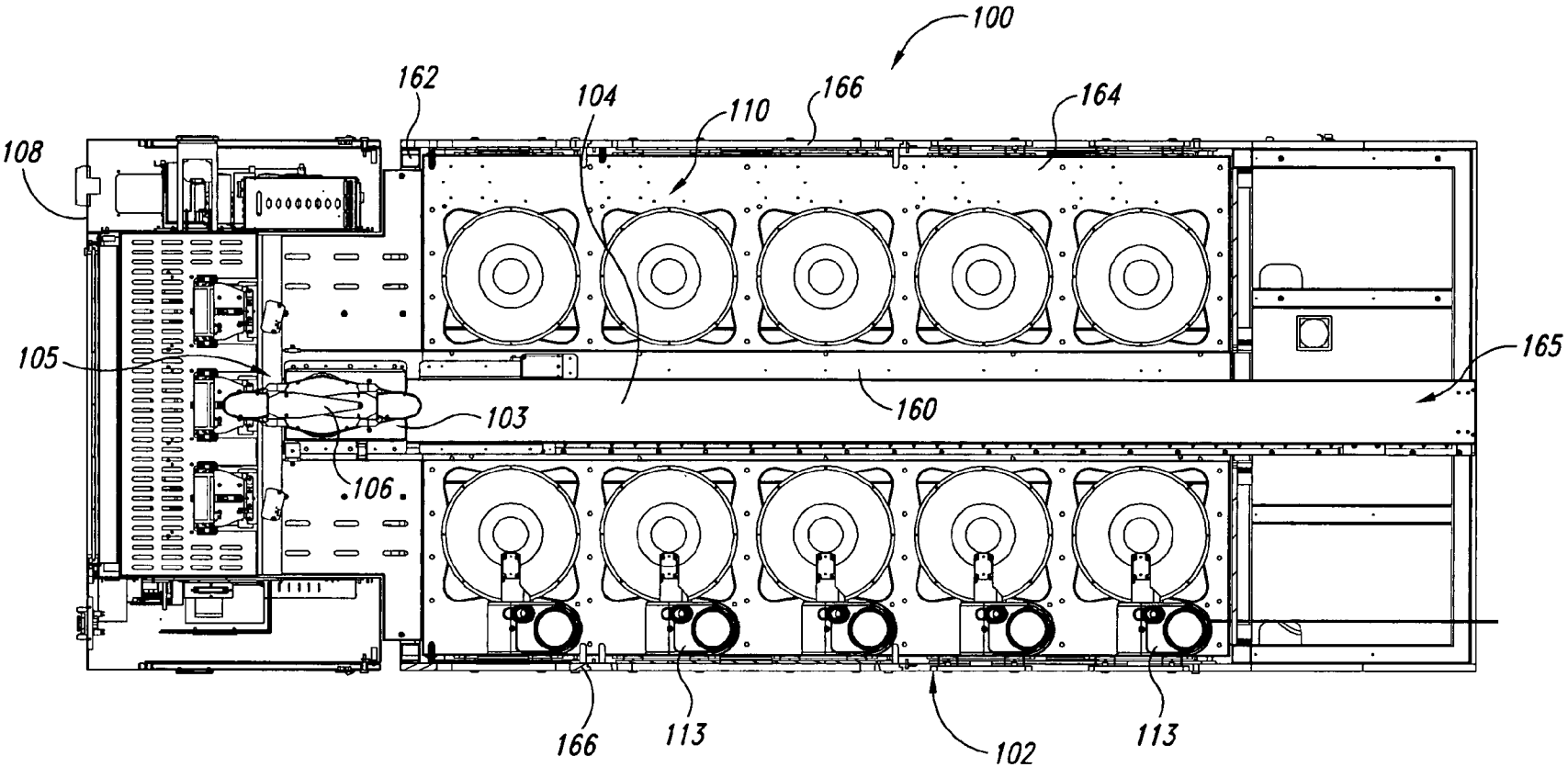
FIG. 2B is a top plan view of a wet chemical processing tool arranged in accordance with an embodiment of the invention.

FIG. 2B is a top plan view of the tool 100 illustrating the transport system 105 and the load/unload unit 108 attached to the mounting module 160. Referring to FIGS. 2A and 2B together, the track 104 is mounted to the platform 165 and in particular, interfaces with positioning elements on the platform 165 so that it is accurately positioned relative to the chambers 110 and the workpiece supports 113 attached to the deck 164. The robot 103 (which includes end-effectors 106 for grasping the workpiece W) can accordingly move the workpiece W in a fixed, dimensionally stable reference frame established by the mounting module 160. Referring to FIG. 2B, the tool 100 can further include a plurality of panels 166 attached to the frame 162 to enclose the mounting module 160, the wet chemical processing chambers 110, the workpiece supports 113, and the transport system 105 in the cabinet 102. Alternatively, the panels 166 on one or both sides of the tool 100 can be removed in the region above the processing deck 164 to provide an open tool.

B. Embodiments of Dimensionally Stable Mounting Modules

Figure 3:
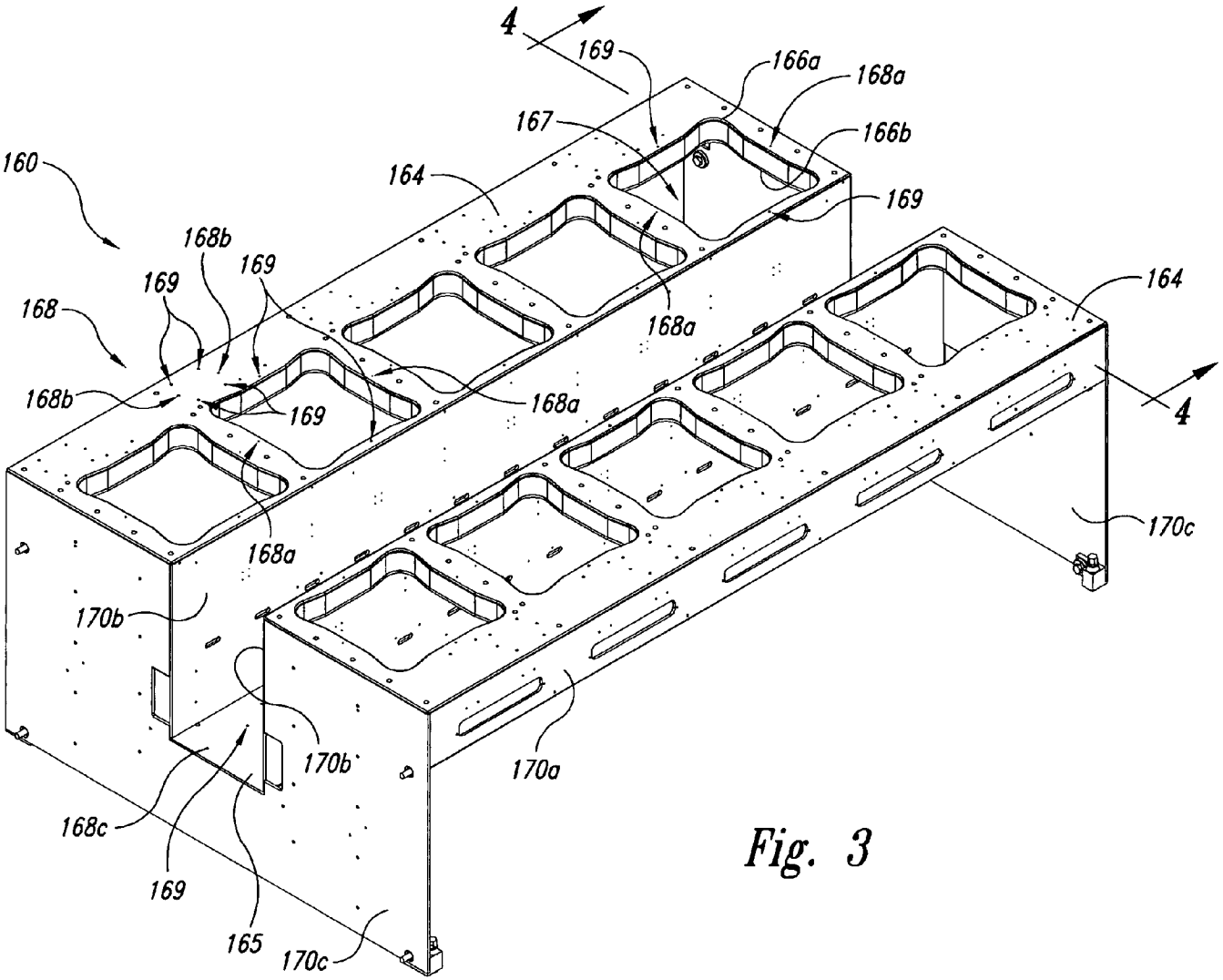
FIG. 3 is an isometric view of a mounting module for use in a wet chemical processing tool in accordance with an embodiment of the invention.

FIG. 3 is an isometric view of a mounting module 160 configured in accordance with an embodiment of the invention for use in the tool 100 (FIGS. 1-2B). The deck 164 includes a rigid first panel 166*a* and a rigid second panel 166*b* superimposed underneath the first panel 166*a*. The first panel 166*a* is an outer member and the second panel 166*b* is an interior member juxtaposed to the outer member. Alternatively, the first and second panels 166*a* and 166*b* can have different configurations than the one shown in FIG. 3. A plurality of chamber receptacles 167 are disposed in the first and second panels 166*a* and 166*b* to receive the wet chemical processing chambers 110 (FIG. 2A).

The deck 164 further includes a plurality of positioning elements 168 and attachment elements 169 arranged in a precise pattern across the first panel 166*a*. The positioning elements 168 include holes machined in the first panel 166*a* at precise locations, and/or dowels or pins received in the holes. The dowels are also configured to interface with the wet chemical processing chambers 110 (FIG. 2A). For example, the dowels can be received in corresponding holes or other interface members of the processing chambers 110. In other embodiments, the positioning elements 168 include pins, such as cylindrical pins or conical pins, that project upwardly from the first panel 166*a* without being positioned in holes in the first panel 166*a*. The deck 164 has a set of first chamber positioning elements 168*a* located at each chamber receptacle 167 to accurately position the individual wet chemical processing chambers at precise locations on the mounting module 160. The deck 164 can also include a set of first support positioning elements 168*b* near each receptacle 167 to accurately position individual workpiece supports 113 (FIG. 2A) at precise locations on the mounting module 160. The first support positioning elements 168*b* are positioned and configured to mate with corresponding positioning elements of the workpiece supports 113. The attachment elements 169 can be threaded holes in the first panel 166*a* that receive bolts to secure the chambers 110 and the workpiece supports 113 to the deck 164.

The mounting module 160 also includes exterior side plates 170*a* along longitudinal outer edges of the deck 164, interior side plates 170*b* along longitudinal inner edges of the deck 164, and endplates 170*c* attached to the ends of the deck 164. The transport platform 165 is attached to the interior side plates 170*b* and the end plates 170*c*. The transport platform 165 includes track positioning elements 168*c* for accurately positioning the track 104 (FIGS. 2A and 2B) of the transport system 105 (FIGS. 2A and 2B) on the mounting module 160. For example, the track positioning elements 168*c* can include pins or holes that mate with corresponding holes, pins or other interface members of the track 104. The transport platform 165 can further include attachment elements 169, such as tapped holes, that receive bolts to secure the track 104 to the platform 165.

Figure 4:
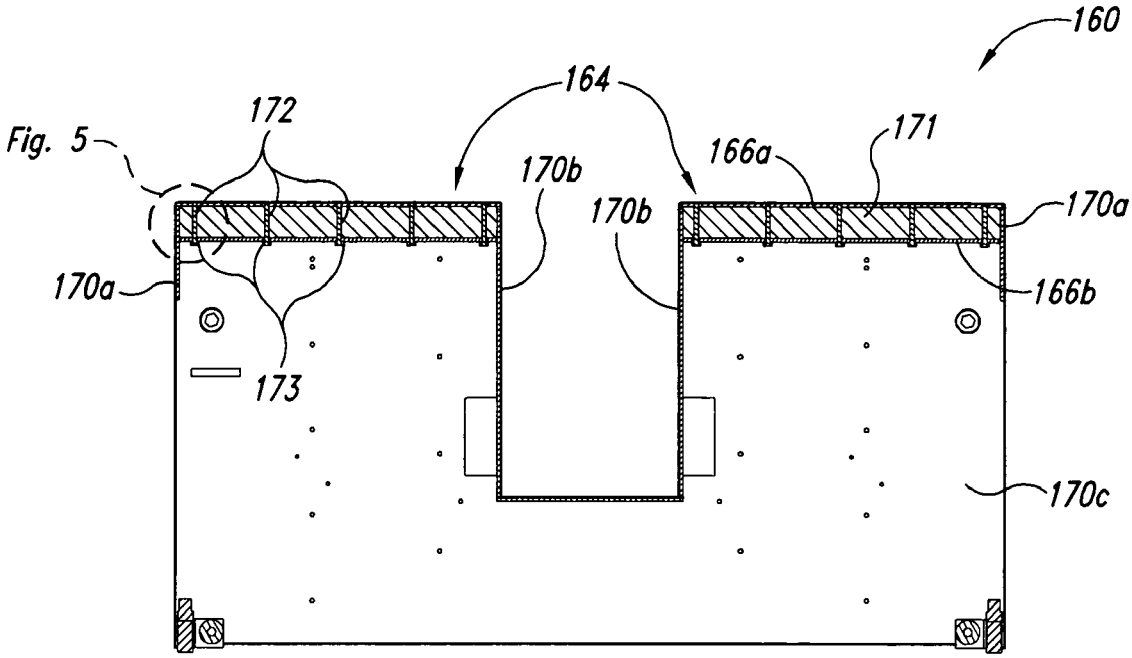
FIG. 4 is cross-sectional view along line 4-4 of FIG. 3 of a mounting module for use in a wet chemical processing tool in accordance with an embodiment to the invention.
Figure 5:
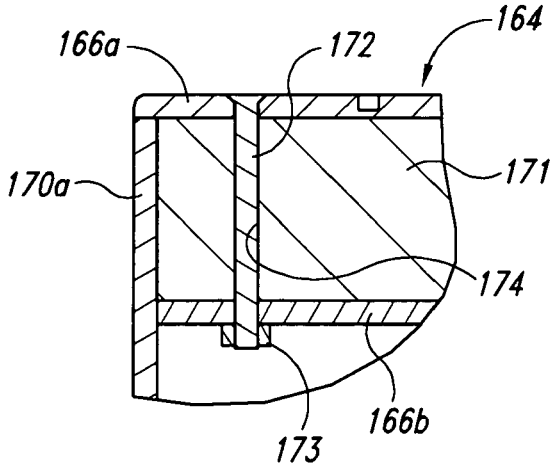
FIG. 5 is a cross-sectional view showing a portion of a deck of a mounting module in greater detail.

FIG. 4 is a cross-sectional view illustrating one suitable embodiment of the internal structure of the deck 164, and FIG. 5 is a detailed view of a portion of the deck 164 shown in FIG. 4. The deck 164 includes bracing 171, such as joists, extending laterally between the exterior side plates 170*a* and the interior side plates 170*b*. The first panel 166*a* is attached to the upper side of the bracing 171, and the second panel 166*b* is attached to the lower side of the bracing 171. The deck 164 can further include a plurality of throughbolts 172 and nuts 173 that secure the first and second panels 166*a* and 166*b* to the bracing 171. As best shown in FIG. 5, the bracing 171 has a plurality of holes 174 through which the throughbolts 172 extend. The nuts 173 can be welded to the bolts 172 to enhance the connection between these components.

The panels and bracing of the deck 164 can be made from stainless steel, other metal alloys, solid cast materials, or fiber-reinforced composites. For example, the panels and plates can be made from Nitronic 50 stainless steel, Hastelloy 625 steel alloys, or a solid cast epoxy filled with mica. The fiber-reinforced composites can include a carbon-fiber or Kevlar® mesh in a hardened resin. The material for the panels 166*a* and 166*b* should be highly rigid and compatible with the chemicals used in the wet chemical processes. Stainless steel is well-suited for many applications because it is strong but not affected by many of the electrolytic solutions or cleaning solutions used in wet chemical processes. In one embodiment, the panels and plates 166*a*-*b* and 170*a*-*c* are 0.125 to 0.375 inch thick stainless steel, and more specifically they can be 0.250 inch thick stainless steel. The panels and plates, however, can have different thicknesses in other embodiments.

The bracing 171 can also be stainless steel, fiber-reinforced composite materials, other metal alloys, and/or solid cast materials. In one embodiment, the bracing can be 0.5 to 2.0 inch wide stainless steel joists, and more specifically 1.0 inch wide by 2.0 inches tall stainless steel joists. In other embodiments the bracing 171 can be a honey-comb core or other structures made from metal (e.g., stainless steel, aluminum, titanium, etc.), polymers, fiber glass or other materials.

The mounting module 160 is constructed by assembling the sections of the deck 164, and then welding or otherwise adhering the end plates 170*c* to the sections of the deck 164. The components of the deck 164 are generally secured together by the throughbolts 172 without welds. The outer side plates 170*a* and the interior side plates 170*b* are attached to the deck 164 and the end plates 170*c* using welds and/or fasteners. The platform 165 is then securely attached to the end plates 170*c*, and the interior side plates 170*b*. The order in which the mounting module 160 is assembled can be varied and is not limited to the procedure explained above.

Returning to FIG. 3, the mounting module 160 provides a heavy-duty, dimensionally stable structure that maintains the relative positions between the positioning elements 168*a*-*b* on the deck 164 and the positioning elements 168*c* on the platform 165 within a range that does not require the transport system 105 to be recalibrated each time a replacement processing chamber 110 or workpiece support 113 is mounted to the deck 164. The mounting module 160 is generally a rigid structure that is sufficiently strong to maintain the relative positions between the positioning elements 168*a*-*b* and 168*c* when the wet chemical processing chambers 110, the workpiece supports 113, and the transport system 105 are mounted to the mounting module 160. In several embodiments, the mounting module 160 is configured to maintain the relative positions between the positioning elements 168*a*-*b* and 168*c* to within 0.025 inch. In other embodiments, the mounting module is configured to maintain the relative positions between the positioning elements 168*a*-*b* and 168*c* to within approximately 0.005 to 0.015 inch. As such, the deck 164 often maintains a uniformly flat surface to within approximately 0.025 inch, and in more specific embodiments to approximately 0.005-0.015 inch.

Figure 6:
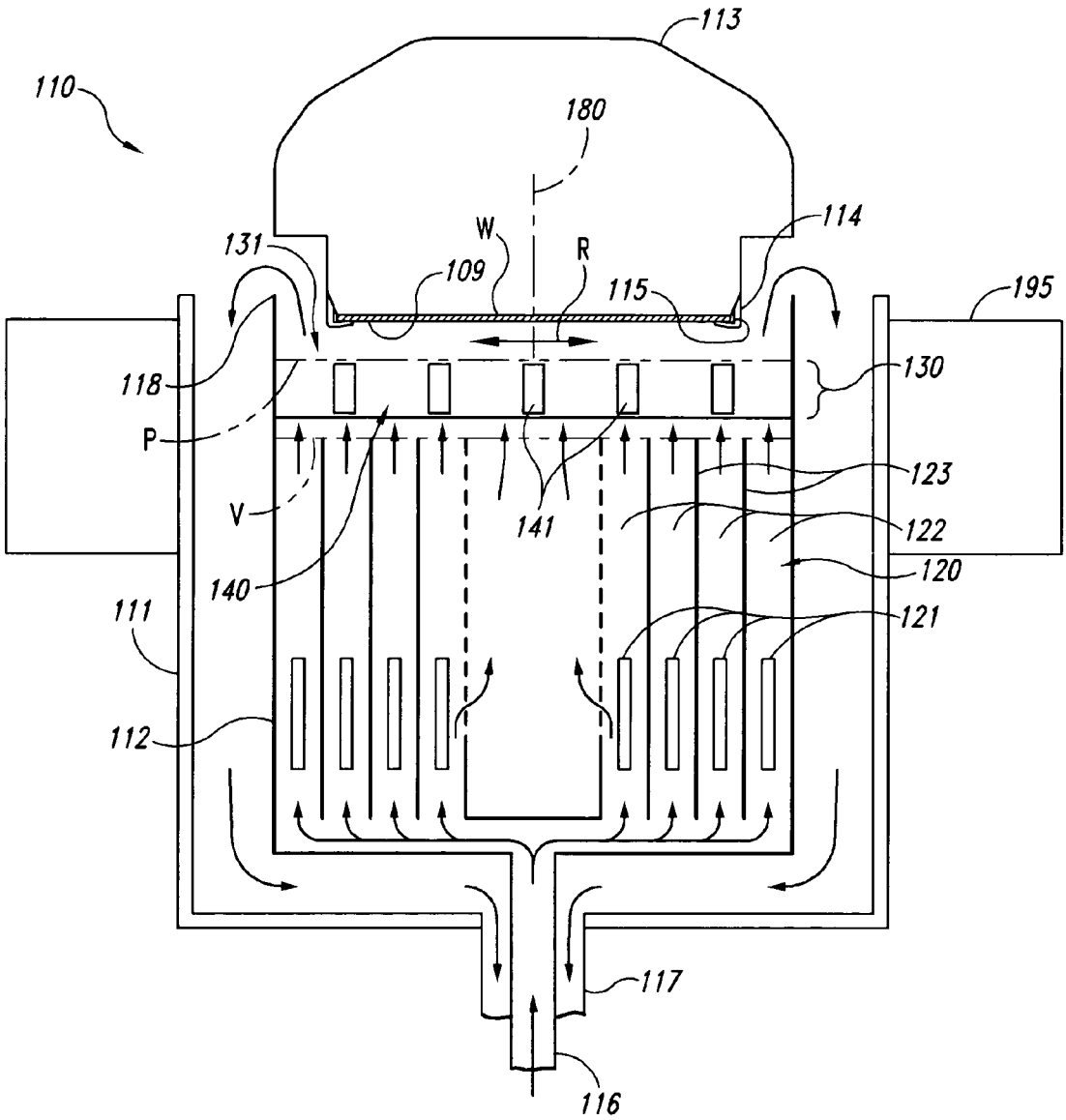
FIG. 6 is a schematic illustration of a reactor having paddles and electrodes configured in accordance with an embodiment of the invention.

C. Embodiments of Reactors Having Multiple Electrodes and Enclosed Paddle Devices FIG. 6 is a schematic illustration of a chamber or reactor 110 configured in accordance with an embodiment of the invention. Further details of aspects of this and other related reactors are included in pending U.S. application Ser. No. 10/734,100, entitled "Reactors Having Multiple Electrodes and/or Enclosed Reciprocating Paddles, and Associated Methods," filed concurrently herewith and incorporated herein in its entirety by reference. The reactor 110 includes an inner vessel 112 positioned within an outer vessel 111. Processing fluid (e.g., an electrolyte) is supplied to the inner vessel 112 at an inlet 116 and flows upwardly over a weir 118 to the outer vessel 111. The processing fluid exits the reactor 110 at a drain 117. An electrode support 120 is positioned between the inlet 116 and the weir 118. The electrode support 120 includes a plurality of generally annular electrode compartments 122, separated by compartment walls 123. A corresponding plurality of annular electrodes 121 are positioned in the electrode compartments 122. The compartment walls 123 are formed from a dielectric material and the gaps between the top edges of the compartment walls 123 define a composite virtual electrode location V. As used herein, the term "virtual anode location" or "virtual electrode location" refers to a plane spaced apart from the physical anodes or electrodes, through which all of the current flux for one or more of the electrodes or anodes passes.

A paddle chamber 130 is positioned proximate to the virtual electrode location V. The paddle chamber 130 includes a paddle device 140 having paddles 141 that reciprocate back and forth relative to a central position 180, as indicated by arrow R. The paddle chamber 130 also has an aperture 131 defining a process location P. A microfeature workpiece W is supported at the process location P by the workpiece support 113, so that a downwardly facing process surface 109 of the workpiece W is in contact with the processing fluid. The paddles 141 agitate the processing fluid at the process surface 109 of the workpiece W. At the same time, the relative value of the electrical potential (e.g., the polarity) applied to each of the electrodes 121, and/or the current flowing through each of the electrodes 121, may be selected to control a manner in which material is added to or removed from the workpiece W. Accordingly, the paddles 141 can enhance the mass transfer process at the process surface 109, while the electrodes 121 provide for a controlled electric field at the process surface 109. Alternatively, the electrodes 121 may be eliminated when the reactor 110 is used to perform processes (such as electroless deposition processes) that still benefit from enhanced mass transfer effects at the process surface 109.

The reactor 110 includes a generally horseshoe-shaped magnet 195 disposed around the outer vessel 111. The magnet 195 includes a permanent magnet and/or an electromagnet positioned to orient molecules of material applied to the workpiece W in a particular direction. For example, such an arrangement is used to apply permalloy and/or other magnetically directional materials to the workpiece W. In other embodiments, the magnet 195 may be eliminated.

The workpiece support 113, positioned above the magnet 195, rotates between a face up position (to load and unload the microfeature workpiece W) and a face down position (for processing). When the workpiece W is in the face down position, the workpiece support 113 descends to bring the workpiece W into contact with the processing fluid at the process location P. The workpiece support 113 can also spin the workpiece W about an axis generally normal to the downwardly facing process surface 109. The workpiece support 113 spins the workpiece W to a selected orientation prior to processing, for example, when the process is sensitive to the orientation of the workpiece W, including during deposition of magnetically directional materials. The workpiece support 113 ascends after processing and then inverts to unload the workpiece W from the reactor 110. The workpiece support 113 may also spin the workpiece W during processing (e.g., during other types of material application and/or removal processes, and/or during rinsing), in addition to or in lieu of orienting the workpiece W prior to processing. Alternatively, the workpiece support 113 may not rotate at all, e.g., when spinning before, during or after processing is not beneficial to the performed process. The workpiece support 113 also includes a workpiece contact 115 (e.g., a ring contact) that supplies electrical current to the front surface or back surface of the workpiece W. A seal 114 extends around the workpiece contact 115 to protect it from exposure to the processing fluid. In another embodiment, the seal 114 can be eliminated.

Figure 7:
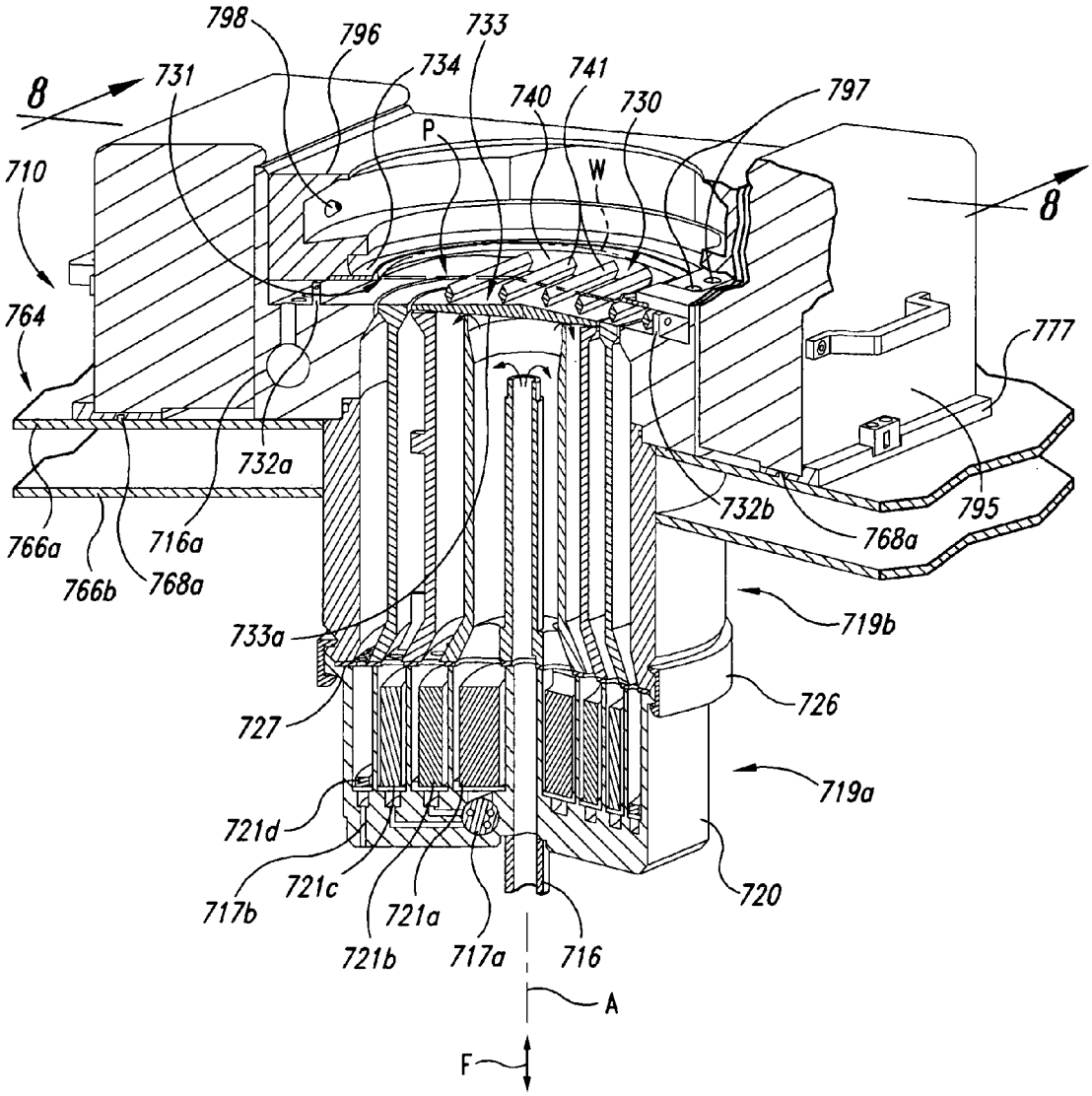
FIG. 7 is a partially cutaway, isometric illustration of a reactor having electrodes and a magnet positioned relative to a paddle chamber in accordance with another embodiment of the invention.

FIG. 7 is a partially schematic, cutaway illustration of a reactor 710 configured in accordance with another embodiment of the invention. The reactor 710 includes a lower portion 719*a*, an upper portion 719*b* above the lower portion 719*a*, and a paddle chamber 730 above the upper portion 719*b*. The lower portion 719*a* houses an electrode support or pack 720 which in turn houses a plurality of annular electrodes 721 (shown in FIG. 7 as electrodes 721*a*-721*d*). The lower portion 719*a* is coupled to the upper portion 719*b* with a clamp 726. A perforated gasket 727 positioned between the lower portion 719*a* and the upper portion 719*b* allows fluid and electrical communication between these two portions.

The paddle chamber 730 includes a base 733, and a top 734 having an aperture 731 at the process location P. The paddle chamber 730 houses a paddle device 740 having multiple paddles 741 that reciprocate back and forth beneath the workpiece W (shown in phantom lines in FIG. 7) at the process location P. A magnet 795 is positioned adjacent to the process location P to control the orientation of magnetically directional materials deposited on the workpiece W by the processing fluid. An upper ring portion 796 positioned above the process location P collects exhaust gases during electrochemical processing, and collects rinse fluid during rinsing. The rinse fluid is provided by one or more nozzles 798. In one embodiment, the nozzle 798 projects from the wall of the upper ring portion 796. In other embodiments, the nozzle or nozzles 798 are flush with or recessed from the wall. In any of these arrangements, the nozzle or nozzles 798 are positioned to direct a stream of fluid (e.g., a rinse fluid) toward the workpiece W when the workpiece W is raised above the process location P and, optionally, while the workpiece W spins. Accordingly, the nozzle(s) 798 provide an in-situ rinse capability, to quickly rinse processing fluid from the workpiece W after a selected processing time has elapsed. This reduces inadvertent processing after the elapsed time, which might occur if chemically active fluids remain in contact with the workpiece W for even a relatively short post-processing time prior to rinsing.

Processing fluid enters the reactor 710 through an inlet 716. Fluid proceeding through the inlet 716 fills the lower portion 719*a* and the upper portion 719*b*, and can enter the paddle chamber 730 through a permeable portion 733*a* of the base 733, and through gaps in the base 733. Some of the processing fluid exits the reactor 710 through first and second flow collectors, 717*a*, 717*b*. Additional processing fluid enters the paddle chamber 730 directly from an entrance port 716*a* and proceeds through a gap in a first wall 732*a*, laterally across the paddle chamber 730 to a gap in a second wall 732*b*. At least some of the processing fluid within the paddle chamber 730 rises above the process location P and exits through drain ports 797. Further details of the flow into and through the paddle chamber 730, and further details of the paddle device 740 are described below in Section F and are included in pending U.S. patent application Ser. No. 10/734,098, entitled "Paddles and Enclosures for Enhancing Mass Transfer During Processing of Microfeature Workpieces," incorporated herein in its entirety by reference and filed concurrently herewith.

The reactor 710 is mounted to a rigid deck 764 in a manner generally similar to that described above with reference to FIGS. 2A-5. Accordingly, the deck 764 includes a first panel 766*a* supported relative to a second panel 766*b* by fasteners and bracing (not shown in FIG. 7). Chamber positioning elements 768*a* (e.g., dowel pins) project upwardly from the first panel 766*a* and are received in precisely positioned holes in a base plate 777 of the reactor 710. The base plate 777 is attached to the deck 764 with fasteners (not shown in FIG. 7), e.g., nuts and bolts. The base plate 777 is also aligned and fastened to the rest of the reactor 710 with additional dowels and fasteners. Accordingly, the reactor 710 (and any replacement reactor 710) is precisely located relative to the deck 764, the corresponding workpiece support 113 (FIG. 1) and the corresponding transport system 105 (FIG. 1).

One feature of the arrangement shown in FIG. 7 is that the lower portion 719*a* (which houses the electrode support 720) is coupled to and decoupled from the upper portion 719*b* by moving the electrode support 720 along an installation/removal axis A, as indicated by arrow F. Accordingly, the electrode support 720 need not pass through the open center of the magnet 795 during installation and removal. An advantage of this feature is that the electrode support 720 (which may include a magnetically responsive material, such as a ferromagnetic material) will be less likely to be drawn toward the magnet 795 during installation and/or removal. This feature can make installation of the electrode support 720 substantially simpler and can reduce the likelihood for damage to either the electrode support 720 or other portions of the reactor 710 (including the magnet 795). Such damage can result from collisions caused by the attractive forces between the magnet 795 and the electrode support 720.

Figure 8:
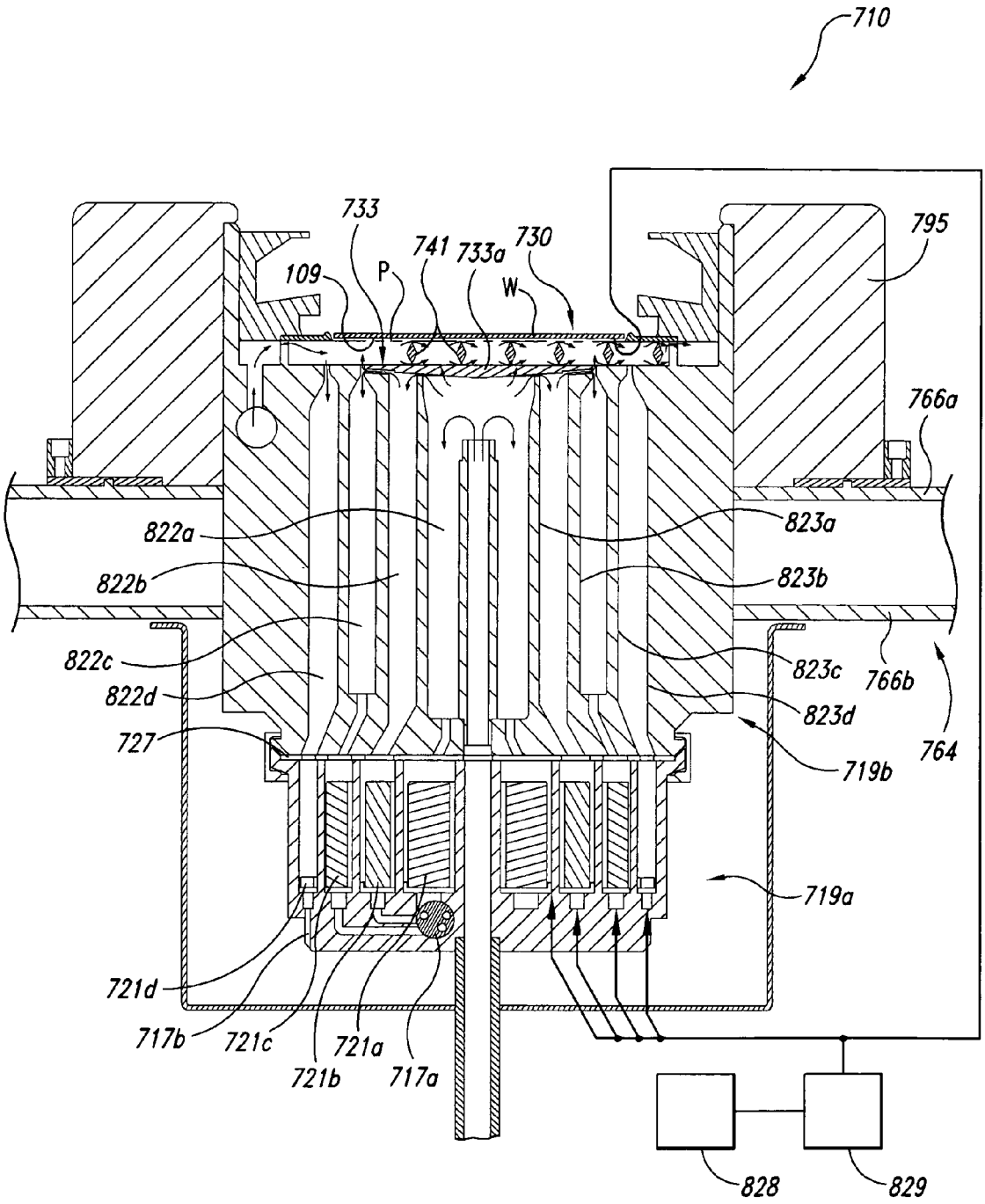
FIG. 8 is a partially schematic, cross-sectional view of the reactor shown in FIG. 7.

FIG. 8 is a cross-sectional side elevation view of an embodiment of the reactor 710 taken substantially along line 8-8 of FIG. 7. The lower and upper portions 719*a*, 719*b* include multiple compartment walls 823 (four are shown in FIG. 8 as compartment walls 823*a*-823*d*) that divide the volume within these portions into a corresponding plurality of annular compartments 822 (four are shown in FIG. 8 as compartments 822*a*-822*d*), each of which houses one of the electrodes 721. The gaps between adjacent compartment walls 823 (e.g., at the tops of the compartment walls 823) provide for "virtual electrodes" at these locations. The permeable base portion 733*a* can also provide a virtual electrode location.

The electrodes 721*a*-721*d* are coupled to a power supply 828 and a controller 829. The power supply 828 and the controller 829 together control the electrical potential and current applied to each of the electrodes 721*a*-721*d*, and the workpiece W. Accordingly, an operator can control the rate at which material is applied to and/or removed from the workpiece W in a spatially and/or temporally varying manner. In particular, the operator can select the outermost electrode 721*d* to operate as a current thief. Accordingly, during a deposition process, the outermost electrode 721*d* attracts ions that would otherwise be attracted to the workpiece W. This can counteract the terminal effect, e.g., the tendency for the workpiece W to plate more rapidly at its periphery than at its center when the workpiece contact 115 (FIG. 6) contacts the periphery of the workpiece W. Alternatively, the operator can temporally and/or spatially control the current distribution across the workpiece W to produce a desired thickness distribution of applied material (e.g., flat, edge thick, or edge thin).

One advantage of the foregoing arrangement is that the multiple electrodes provide the operator with increased control over the rate and manner with which material is applied to or removed from the workpiece W. Another advantage is that the operator can account for differences between consecutively processed workpieces or workpiece batches by adjusting the current and/or electric potential applied to each electrode, rather than physically adjusting parameters of the reactor 710. Further details of multiple electrode arrangements and arrangements for controlling the electrodes are included in the following pending U.S. application Ser. Nos: 09/804,697, entitled "System for Electrochemically Processing a Workpiece," filed Mar. 2, 2001; 60/476,891, entitled "Electrochemical Deposition Chambers for Depositing Materials Onto Microfeature Workpieces," filed Jun. 6, 2003; 10/158,220, entitled "Methods and Systems for Controlling Current in Electrochemical Processing of Microelectronic Workpieces," filed May 29, 2002; and 10/426,029, entitled, "Method and Apparatus for Controlling Vessel Characteristics, Including Shape and Thieving Current for Processing Microelectronic Workpieces," filed Apr. 28, 2003, all incorporated herein in their entireties by reference.

When the outermost electrode 721*d* operates as a current thief, it is desirable to maintain electrical isolation between the outermost electrode 721*d* on the one hand and the innermost electrodes 721*a*-721*c* on the other. Accordingly, the reactor 710 includes a first return flow collector 717*a* and a second return flow collector 717*b*. The first return flow collector 717*a* collects flow from the innermost three electrode compartments 822*a*-822*c*, and the second return flow collector 717*b* collects processing fluid from the outermost electrode compartment 822*d* to maintain electrical isolation for the outermost electrode 721*d*. By draining the processing fluid downwardly toward the electrodes 721, this arrangement can also reduce the likelihood for particulates (e.g., flakes from consumable electrodes) to enter the paddle chamber 730. By positioning the outermost electrode 721*d* remotely from the process location P, it can be easily removed and installed without disturbing structures adjacent to the process location P. This is unlike some existing arrangements having current thieves positioned directly adjacent to the process location.

One feature of an embodiment of the reactor 710 described above with reference to FIGS. 7 and 8 is that the electrodes 721 are positioned remotely from the process location P. An advantage of this feature is that the desired distribution of current density at the process surface 109 of the workpiece W can be maintained even when the electrodes 721 change shape. For example, when the electrodes 721 include consumable electrodes and change shape during plating processes, the increased distance between the electrodes 721 and the process location P reduces the effect of the shape change on the current density at the process surface 109, when compared with the effect of electrodes positioned close to the process location P. Another advantage is that shadowing effects introduced by features in the flow path between the electrodes 721 and the workpiece W (for example, the gasket 727) can be reduced due to the increased spacing between the electrodes 721 and the process location P.

In other arrangements, the electrodes 721 have other locations and/or configurations. For example, in one arrangement, the chamber base 733 houses one or more of the electrodes 721. Accordingly, the chamber base 733 may include a plurality of concentric, annular, porous electrodes (formed, for example, from sintered metal) to provide for (a) spatially and/or temporally controllable electrical fields at the process location P, and (b) a flow path into the paddle chamber 730. Alternatively, the paddles 741 themselves may be coupled to an electrical potential to function as electrodes, in particular, when formed from a non-consumable material. In still other arrangements, the reactor 710 may include more or fewer than four electrodes, and/or the electrodes may be positioned more remotely from the process location P, and may maintain fluid and electrical communication with the process location P via conduits.

Figure 9:
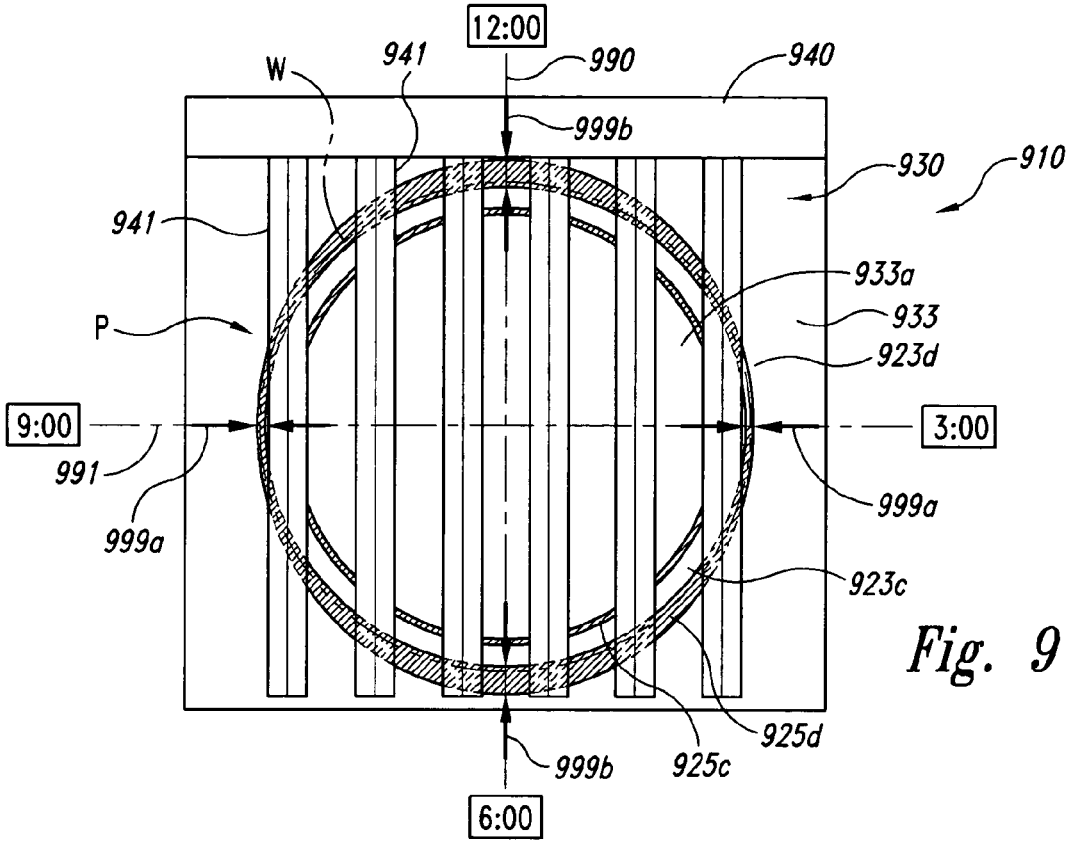
FIG. 9 is a schematic illustration of an electric field control element configured to circumferentially vary the effect of an electrode in accordance with an embodiment of the invention.

D. Embodiments of Reactors Having Electric Field Control Elements to Circumferentially Vary an Electric Field FIG. 9 is a partially schematic illustration looking downwardly on a reactor 910 having a paddle device 940 positioned in a paddle chamber 930 in accordance with an embodiment of the invention. The paddle chamber 930 and the paddle device 940 are arranged generally similarly to the paddle chambers and the paddle devices described above with reference to FIGS. 6-8. Accordingly, the paddle device 940 includes a plurality of paddles 941 elongated parallel to a paddle axis 990 and movable relative to a workpiece W (shown in phantom lines in FIG. 9) along a paddle motion axis 991.

The elongated paddles 941 can potentially affect the uniformity of the electric field proximate to the circular workpiece W in a circumferentially varying manner. Accordingly, the reactor 910 includes features for circumferentially varying the effect of the thieving electrode (not visible in FIG. 9) to account for this potential circumferential variation in current distribution.

The paddle chamber 930 shown in FIG. 9 includes a base 933 formed by a permeable base portion 933*a* and by the upper edges of walls 923 that separate the electrode chambers below (a third wall 923*c* and a fourth or outer wall 923*d* are visible in FIG. 9). The third wall 923*c* is spaced apart from the permeable base portion 933*a* by a third wall gap 925*c*, and the fourth wall 923*d* is spaced apart from the third wall 923*c* by a circumferentially varying fourth wall gap 925*d*. Both gaps 925*c* and 925*d* are shaded for purposes of illustration. The shaded openings also represent the virtual anode locations for the outermost two electrodes, in one aspect of this embodiment.

The fourth wall gap 925*d* has narrow portions 999*a* proximate to the 3:00 and 9:00 positions shown in FIG. 9, and wide portions 999*b* proximate to the 12:00 and 6:00 positions shown in FIG. 9. For purposes of illustration, the disparities between the narrow portions 999*a* and the wide portions 999*b* are exaggerated in FIG. 9. In a particular example, the narrow portions 999*a* have a width of about 0.16 inches, and the wide portions 999*b* have a width of from about 0.18 inches to about 0.22 inches. The narrow portions 999*a* and the wide portions 999*b* create a circumferentially varying distribution of the thief current (provided by a current thief located below the fourth wall gap 925*d*) that is stronger at the 12:00 and 6:00 positions than at the 3:00 and 9:00 positions. In particular, the thief current can have different values at different circumferential locations that are approximately the same radial distance from the center of the process location P and/or the workpiece W. Alternatively, a circumferentially varying fourth wall gap 925*d* or a circumferentially varying third wall gap 925*c* or other gap can be used to deliberately create a three dimensional effect, for example on a workpiece W that has circumferentially varying plating or deplating requirements. One example of such a workpiece W includes a patterned wafer having an open area (e.g., accessible for plating) that varies in a circumferential manner. In further embodiments, the gap width or other characteristics of the reactor 910 can be tailored to account for the conductivity of the electrolyte in the reactor 510.

Figure 10:
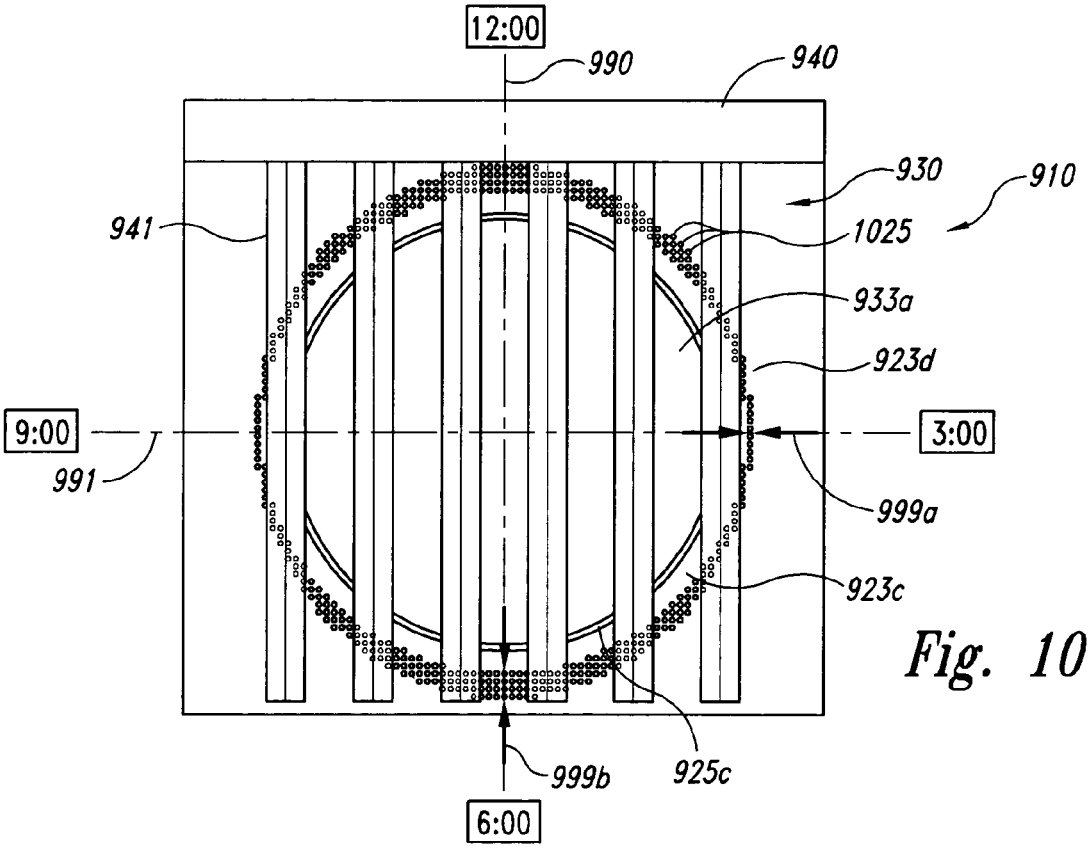
FIG. 10 is a partially schematic illustration of another embodiment of an electric field control element.

FIG. 10 illustrates an arrangement in which the region between the third wall 923*c* and the fourth wall 923*d* is occupied by a plurality of holes 1025 rather than a gap. The spacing and/or size of the holes 1025 varies in a circumferential manner so that a current thief positioned below the holes 1025 has a stronger effect proximate to the 12:00 and 6:00 positions then proximate to the 3:00 and 9:00 positions.

Figure 11:
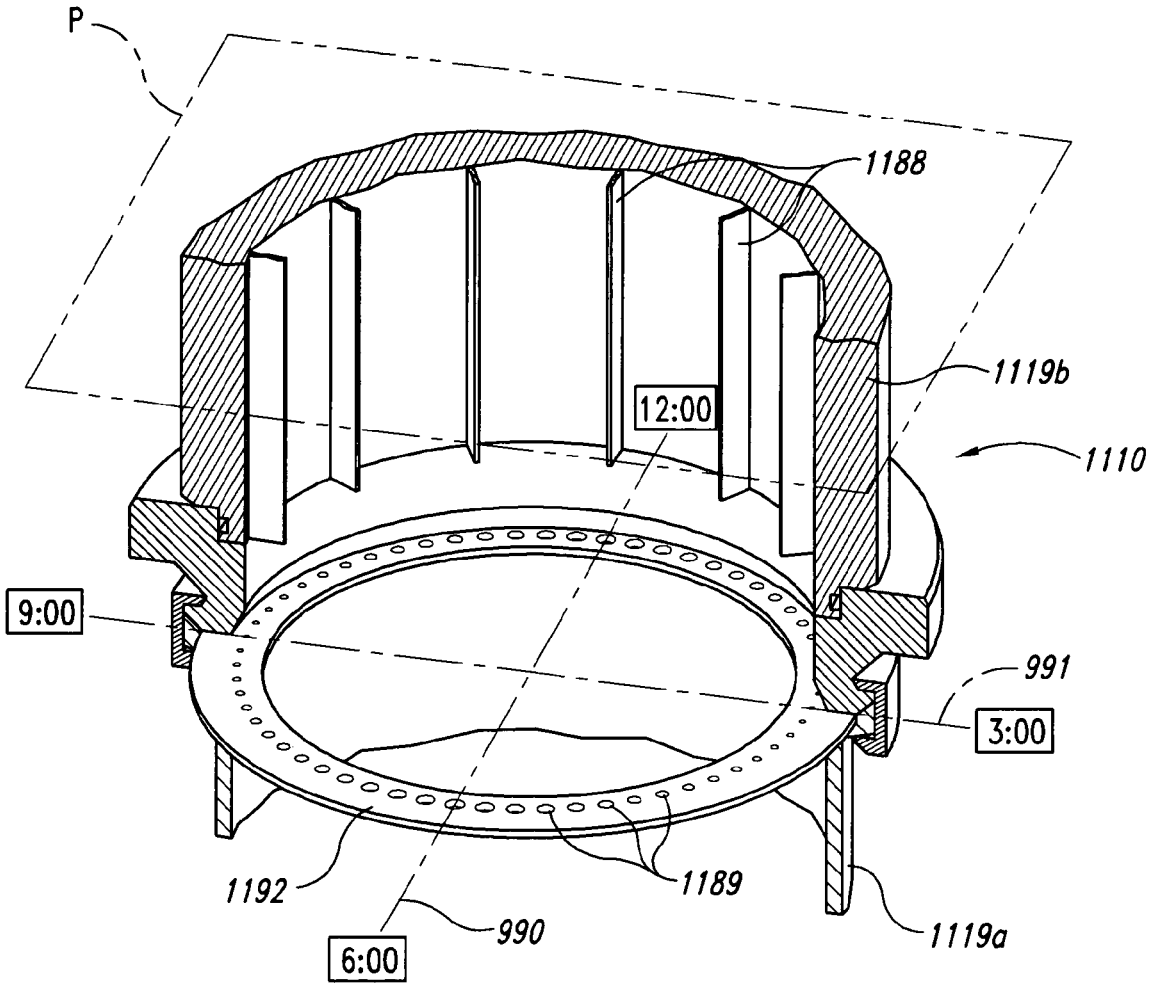
FIG. 11 is a partially schematic, isometric illustration of an electric field control element that also functions as a gasket in accordance with an embodiment of the invention.

FIG. 11 is a partially cut-away, isometric view of a portion of a reactor 1110 having an electric field control element 1192 that is not part of the paddle chamber. The reactor 1110 includes an upper portion 1119*b* that replaces the upper portion 719*b* shown in FIG. 7. The electric field control element 1192 is positioned at the lower end of the upper portion 1119*b* and has openings 1189 arranged to provide a circumferentially varying open area. The openings 1189 are larger at the 12:00 and 6:00 positions than they are at the 3:00 and 9:00 positions. Alternatively, the relative number of openings 1189 (instead of or in addition to the size of openings 1189) may be greater at the 12:00 and 6:00 positions in a manner generally similar to that described above with reference to FIG. 10. The upper portion 1119*b* also includes upwardly extending vanes 1188 that maintain the circumferentially varying electrical characteristics caused by the electric field control element 1192, in a direction extending upwardly to the process location P. The reactor 1110 may include twelve vertically extending vanes 1188, or other numbers of vanes 1188, depending, for example, on the degree to which the open area varies in the circumferential direction.

The electric field control element 1192 also functions as a gasket between the upper portion 1119*b* and a lower portion 1119*a* of the reactor 1110, and can replace the gasket 727 described above with reference to FIG. 7 to achieve the desired circumferential electric field variation. Alternatively, the electric field control element 1192 may be provided in addition to the gasket 727, for example, at a position below the gasket 727 shown in FIG. 7. In either case, an operator can select and install an electric field control element 1192 having open areas configured for a specific workpiece (or batch of workpieces), without disturbing the upper portion 1119*b* of the reactor 1110. An advantage of this arrangement is that it reduces the time required by the operator to service the reactor 1110 and/or tailor the electric field characteristics of the reactor 1110 to a particular type of workpiece W.

E. Embodiments of Paddles for Paddle Chambers

FIGS. 12A-12G illustrate paddles 1241*a*-1241*g*, respectively, having shapes and other features in accordance with further embodiments of the invention, and being suitable for installation in reactors such as the reactors 110, 710 and 1110 described above. Each of the paddles (referred to collectively as paddles 1241) has opposing paddle surfaces 1247 (shown as paddle surfaces 1247*a*-1247*g*) that are inclined at an acute angle relative to a line extending normal to the process location P. This provides the paddles 1241 with a downwardly tapered shape that reduces the likelihood for shadowing or otherwise adversely influencing the electric field created by the electrode or electrodes 121 (FIG. 12A) while maintaining the structural integrity of the paddles. The overall maximum width of each paddle is generally kept as small as possible to further reduce shadowing. For example, the paddle 1241*a* (FIG. 12A) has a generally diamond-shaped cross-sectional configuration with flat paddle surfaces 1247*a*. The paddle 1241*b* (FIG. 12B) has concave paddle surfaces 1247*b*. The paddle 1241*c* (FIG. 12C) has convex paddle surfaces 1247*c*, and the paddle 1241*d* (FIG. 12D) has flat paddle surfaces 1247*d* positioned to form a generally triangular shape. In other embodiments, the paddles 1241 have other shapes that also agitate the flow at the process location P and reduce or eliminate the extent to which they shadow the electrical field created by the nearby electrode or electrodes 121.

Figure 12A:
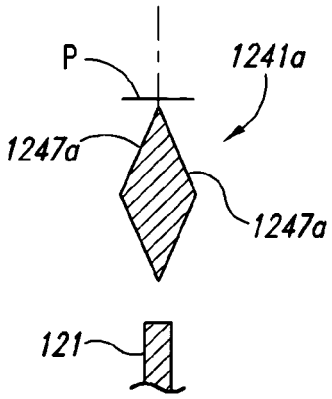
FIGS. 12A-12G illustrate paddles having shapes and configurations in accordance with further embodiments of the invention.
Figure 12B:
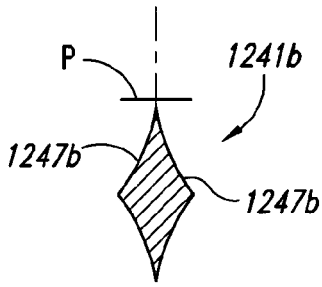
Figure 12C:
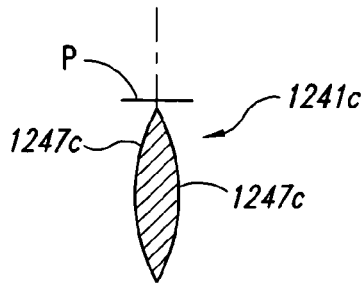
Figure 12D:
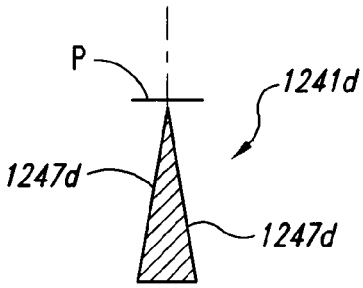
Figure 12E:
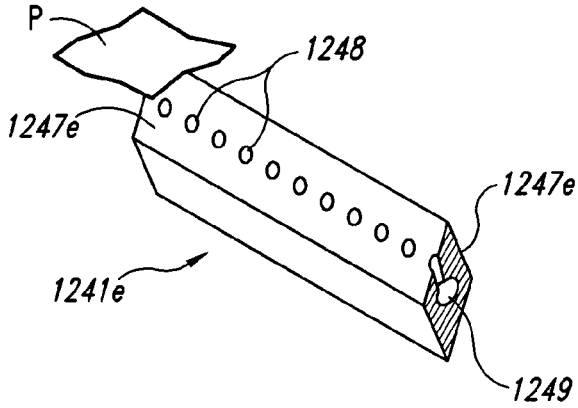

The agitation provided by the paddles 1241 may also be supplemented by fluid jets. For example, the paddle 1241*e* (FIG. 12E) has canted paddle surfaces 1247*e* that house jet apertures 1248. The jet apertures 1248 can be directed generally normal to the process location P (as shown in FIG. 12E); alternatively, the jet apertures 1248 can be directed at other angles relative to the process location P. The processing fluid is provided to the jet apertures 1248 via a manifold 1249 internal to the paddle 1241*e*. Jets of processing fluid exiting the jet apertures 1248 increase the agitation at the process location P and enhance the mass transfer process taking place at the process surface 109 of the workpiece W (FIG. 6). Aspects of other paddle arrangements are disclosed in U.S. Pat. No. 6,547,937, incorporated herein in its entirety by reference.

Figure 12F:
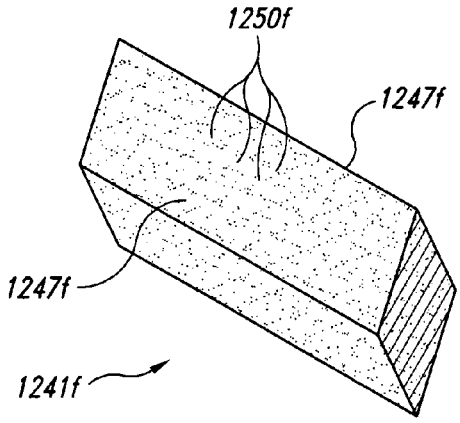
Figure 12G:
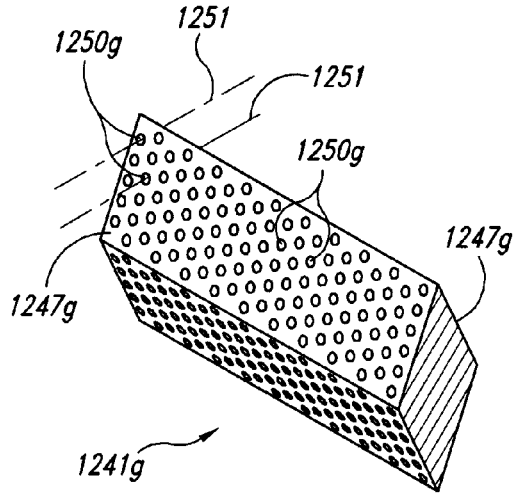

FIGS. 12F and 12G illustrate paddles having perforations or other openings that allow the processing fluid to flow through the paddles from one side to the other as the paddles move relative to the processing fluid. For example, referring first to FIG. 12F, the paddle 1241*f* has opposing paddle surfaces 1247*f*, each with pores 1250*f*. The volume of the paddle 1241*f* between the opposing paddle surfaces 1247*f* is also porous to allow the processing fluid to pass through the paddle 1241*f* from one side surface 1247*f* to the other. The paddle 1241*f* may be formed from a porous metal (e.g., titanium) or other materials, such as porous ceramic materials. FIG. 12G illustrates a paddle 1241*g* having paddle surfaces 1247*g* with through-holes 1250*g* arranged in accordance with another embodiment of the invention. Each of the through-holes 1250*g* extends entirely through the paddle 1241*g* along a hole axis 1251, from one paddle surface 1247*g* to the opposing paddle surface 1247*g*.

One feature of the paddles described above with reference to FIGS. 12F and 12G is that the holes or pores have the effect of increasing the transparency of the paddles to the electric field in the adjacent processing fluid. An advantage of this arrangement is that the pores or holes reduce the extent to which the paddles add a three-dimensional component to the electric fields proximate to the workpiece W, and/or the extent to which the paddles shadow the adjacent workpiece W. Nonetheless, the paddles still enhance the mass transfer characteristics at the surface of the workpiece W by agitating the flow there. For example, the holes or pores in the paddles are sized so that the viscous effects of the flow through the paddles are strong, and the corresponding restriction by the paddles to the flow passing through is relatively high. Accordingly, the porosity of the paddles can be selected to provide the desired level of electric field transparency while maintaining the desired level of fluid agitation.

Figure 13:
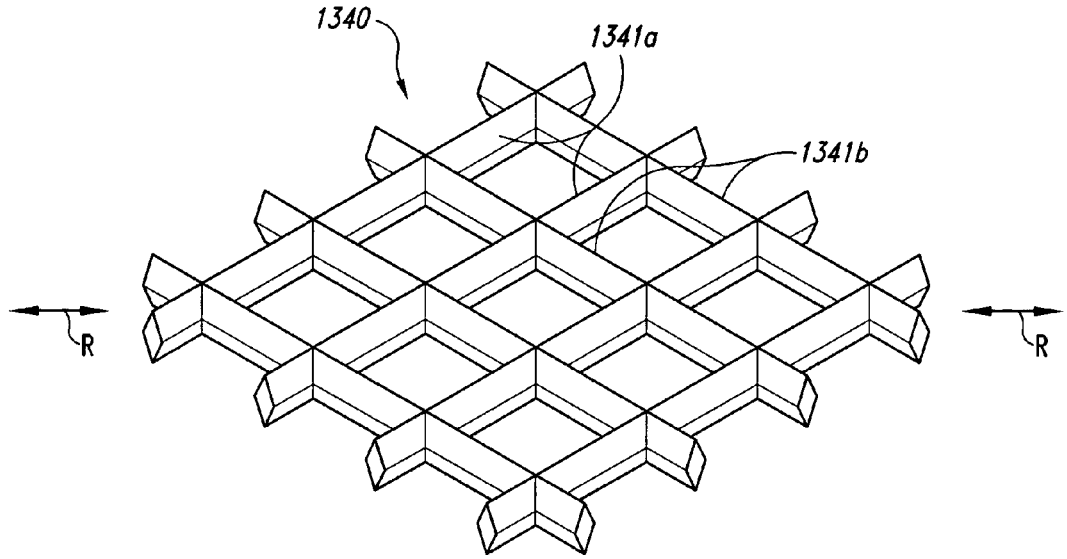
FIG. 13 is an isometric illustration of a paddle device having a grid configuration.

FIG. 13 is a partially schematic illustration of a paddle device 1340 having a three-dimensional arrangement of paddles 1341 (shown in FIG. 13 as first paddles 1341*a* and second paddles 1341*b*). The paddles 1341*a*, 1341*b* are arranged to form a grid, with each of the paddles 1341*a*, 1341*b* oriented at an acute angle relative to the motion direction R (as opposed to being normal to the motion direction R). Accordingly, the grid arrangement of paddles 1341 can increase the agitation created by the paddle device 1340 and create a more uniform electric field.

One aspect of the present invention, is that, whatever shape and configuration the paddles have, they reciprocate within the confines of a close-fitting paddle chamber. The confined volume of the paddle chamber can further enhance the mass transfer effects at the surface of the workpiece W. Further details of the paddle chamber and the manner in which the paddles are integrated with the paddle chamber are described below with reference to FIGS. 14-19F.

Figure 14:
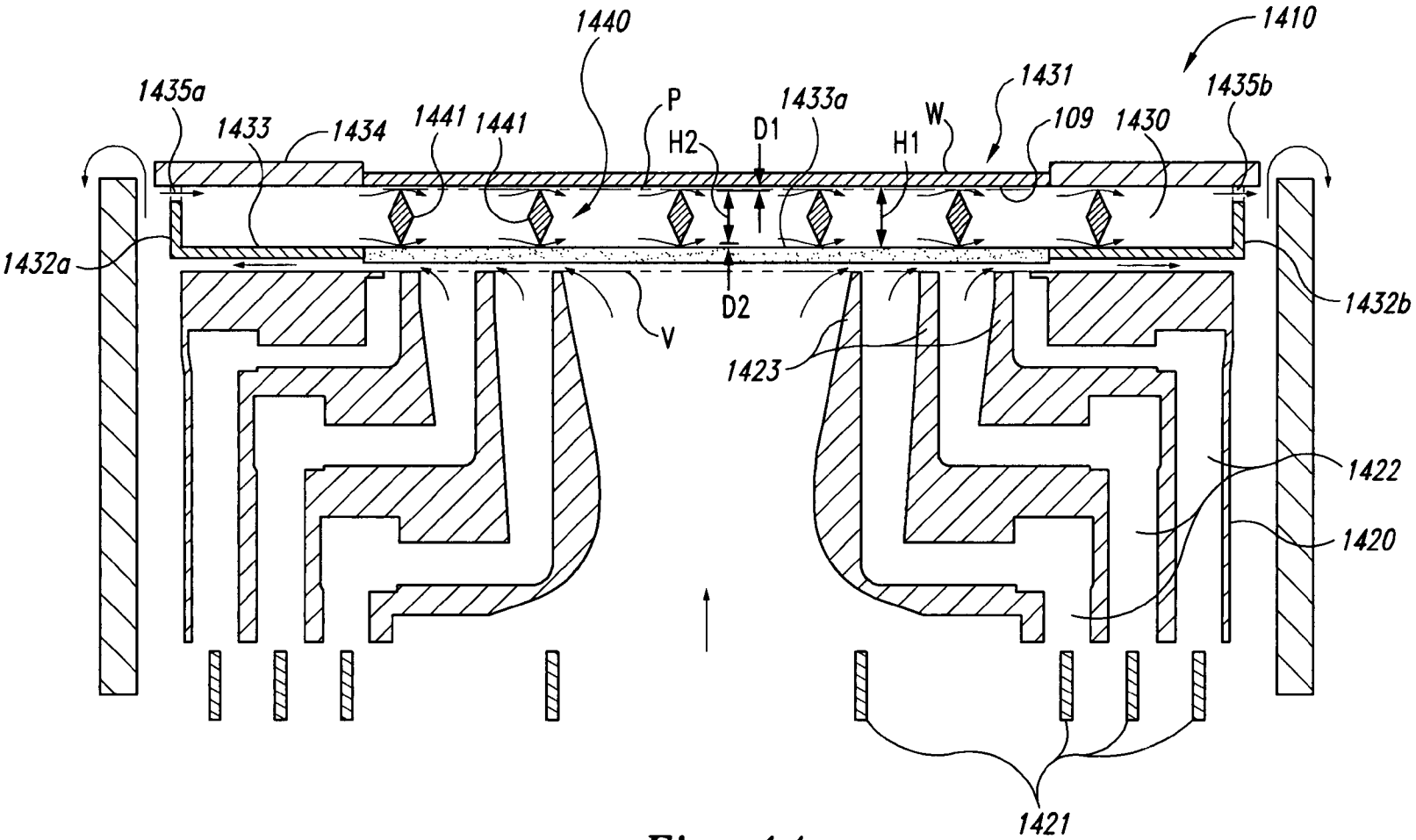
FIG. 14 schematically illustrates flow into and out of a paddle chamber in accordance with an embodiment of the invention.

F. Embodiments of Reactors Having Paddles and Reciprocation Schedules to Reduce Electric Field Shielding and Improve Mass Transfer Uniformity FIG. 14 is a schematic illustration of the upper portion of a reactor 1410 having a paddle device 1440 disposed in a closely confined paddle chamber 1430 in accordance with an embodiment of the invention. The chamber 1430 includes a top 1434 having an aperture 1431 to receive the workpiece W at the process location P. Opposing chamber walls 1432 (shown as a left wall 1432*a* and a right wall 1432*b*) extend downwardly away from the top 1434 to a base 1433 that faces toward the process location P.

The paddle device 1440 includes a plurality of paddles 1441 positioned between the process location P and the chamber base 1433. The paddle chamber 1430 has a height H1 between the process location P and the chamber base 1433, and the paddles 1441 have a height H2. The tops of the paddles 1441 are spaced apart from the process location P by a gap distance D1, and the bottoms of the paddles 1441 are spaced apart from the chamber base 1433 by a gap distance D2. In order to increase the level of agitation in the paddle chamber 1430 and in particular at the process location P, the paddle height H2 is a substantial fraction of the chamber height H1, and the gap distances D1 and D2 are relatively small. In a particular example, the paddle height H2 is at least 30% of the chamber height H1. In further particular examples, the paddle height H2 is equal to at least 70%, 80%, 90% or more of the chamber height H1. The chamber height H1 can be 30 millimeters or less, e.g., from about 10 millimeters to about 15 millimeters. When the chamber height H1 is about 15 millimeters, the paddle height H2 can be about 10 millimeters, with the gap distances D1 and D2 ranging from about 1 millimeter or less to about 5 millimeters. In yet a further particular example, the chamber height H1 is 15 millimeters, the paddle height H2 is about 11.6 millimeters, D1 is about 2.4 millimeters and D2 is about 1 millimeter. Other arrangements have different values for these dimensions. In any of these arrangements, the amount of flow agitation within the paddle chamber 1430 is generally correlated with the height H2 of the paddles 1441 relative to the height H1 of the paddle chamber 1430, with greater relative paddle height generally causing increased agitation, all other variables being equal.

The plurality of paddles 1441 more uniformly and more completely agitates the flow within the paddle chamber 1430 (as compared with a single paddle 1441) to enhance the mass transfer process at the process surface 109 of the workpiece W. The narrow clearances between the edges of the paddles 1441 and (a) the workpiece W above and (b) the chamber base 1433 below, within the confines of the paddle chamber 1430, also increase the level of agitation at the process surface 109. In particular, the movement of the multiple paddles 1441 within the small volume of the paddle chamber 1430 forces the processing fluid through the narrow gaps between the paddles 1441 and the workpiece W (above) and the chamber base 1433 (below). The confined volume of the paddle chamber 1430 also keeps the agitated flow proximate to the process surface 109.

An advantage of the foregoing arrangement is that the mass transfer process at the process surface 109 of the workpiece W is enhanced. For example, the overall rate at which material is removed from or applied to the workpiece W is increased. In another example, the composition of alloys deposited on the process surface 109 is more accurately controlled and/or maintained at target levels. In yet another example, the foregoing arrangement increases the uniformity with which material is deposited on features having different dimensions (e.g., recesses having different depths and/or different aspect ratios), and/or similar dimensions. The foregoing results can be attributed to reduced diffusion layer thickness and/or other mass transfer enhancements resulting from the increased agitation of the processing fluid.

The processing fluid enters the paddle chamber 1430 by one or both of two flow paths. Processing fluid following a first path enters the paddle chamber 1430 from below. Accordingly, the processing fluid passes through electrode compartments 1422 of an electrode support 1420 located below the paddle chamber 1430. The processing fluid passes laterally outwardly through gaps between compartment walls 1423 and the chamber base 1433. The chamber base 1433 includes a permeable base portion 1433*a* through which at least some of the processing fluid passes upwardly into the paddle chamber 1440. The permeable base portion 1433*a* includes a porous medium, for example, porous aluminum ceramic with 10 micron pore openings and approximately 50% open area. Alternatively, the permeable base portion 1433*a* may include a series of through-holes or perforations. For example, the permeable base portion 1433*a* may include a perforated plastic sheet. With any of these arrangements, the processing fluid can pass through the permeable base portion 1433*a* to supply the paddle chamber 1430 with processing fluid; or (if the permeable base portion 1433*a* is highly flow restrictive) the processing fluid can simply saturate the permeable base portion 1433*a* to provide a fluid and electrical communication link between the process location P and annular electrodes 1421 housed in the electrode support 1420, without flowing through the permeable base portion 1433*a* at a high rate. Alternatively (for example, if the permeable base portion 1433*a* traps bubbles that interfere with the uniform fluid flow and/or electrical current distribution), the permeable base portion 1433*a* can be removed, and (a) replaced with a solid base portion, or (b) the volume it would normally occupy can be left open.

Processing fluid following a second flow path enters the paddle chamber 1430 via a flow entrance 1435*a*. The processing fluid flows laterally through the paddle chamber 1430 and exits at a flow exit 1435*b*. The relative volumes of processing fluid proceeding along the first and second flow paths can be controlled by design to (a) maintain electrical communication with the electrodes 1421 and (b) replenish the processing fluid within the paddle chamber 1430 as the workpiece W is processed.

Figure 15:
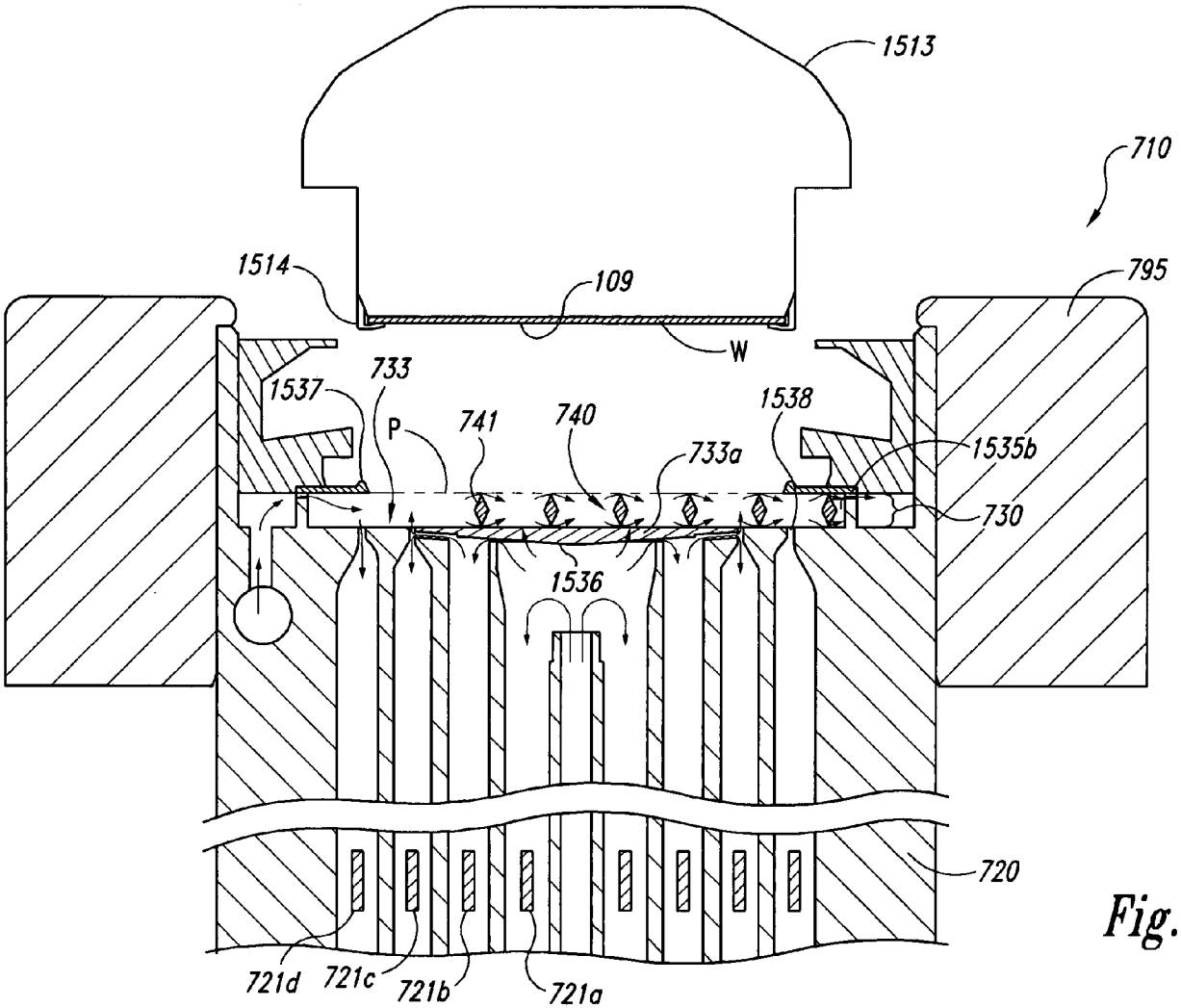
FIG. 15 is a partially schematic illustration of a reactor having a paddle chamber in accordance with another embodiment of the invention.

FIG. 15 illustrates further details of the reactor 710 described above under Sections C and D. The paddle chamber 730 has a permeable base portion 733*a* with an upwardly canted conical lower surface 1536. Accordingly, if bubbles are present in the processing fluid beneath the base 733, they will tend to migrate radially outwardly along the lower surface 1536 until they enter the paddle chamber 730 through base gaps 1538 in the base 733. Once the bubbles are within the paddle chamber 730, the paddles 741 of the paddle device 740 tend to move the bubbles toward an exit gap 1535*b* where they are removed. As a result, bubbles within the processing fluid will be less likely to interfere with the application or removal process taking place at the process surface 109 of the workpiece W.

The workpiece W (e.g., a round workpiece W having a diameter of 150 millimeters, 300 millimeters or other values) is supported by a workpiece support 1513 having a support seal 1514 that extends around the periphery of the workpiece W. When the workpiece support 1513 lowers the workpiece W to the process location P, the support seal 1514 can seal against a chamber seal 1537 located at the top of the paddle chamber 730. Alternatively, the support seal 1514 can be spaced apart from the chamber seal 1537 to allow fluid and/or gas bubbles to pass out of the paddle chamber 730 and/or to allow the workpiece W to spin or rotate. The processing fluid exiting the paddle chamber 730 through the exit gap 1535*b* rises above the level of the chamber seal 1537 before exiting the reactor 710. Accordingly, the chamber seal 1537 will tend not to dry out and is therefore less likely to form crystal deposits, which can interfere with its operation. The chamber seal 1537 remains wetted when the workpiece support 1513 is moved upwardly from the process location P (as shown in FIG. 15) and, optionally, when the workpiece support 1513 carries the workpiece W at the process location P.

Because the workpiece W is typically not rotated when magnetically directional materials are applied to it (e.g., in conjunction with use of the magnet 795), the linearly reciprocating motion of the plurality of paddles 741 is a particularly significant method by which to reduce the diffusion layer thickness by an amount that would otherwise require very high workpiece spin rates to match. For example, a paddle device having six paddles 741 moving at 0.2 meters/second can achieve an iron diffusion layer thickness of less than 18 microns in a permalloy bath. Without the paddles, the workpiece W would have to be spun at 500 rpm to achieve such a low diffusion layer thickness, which is not feasible when depositing magnetically responsive materials.

Figure 16A:
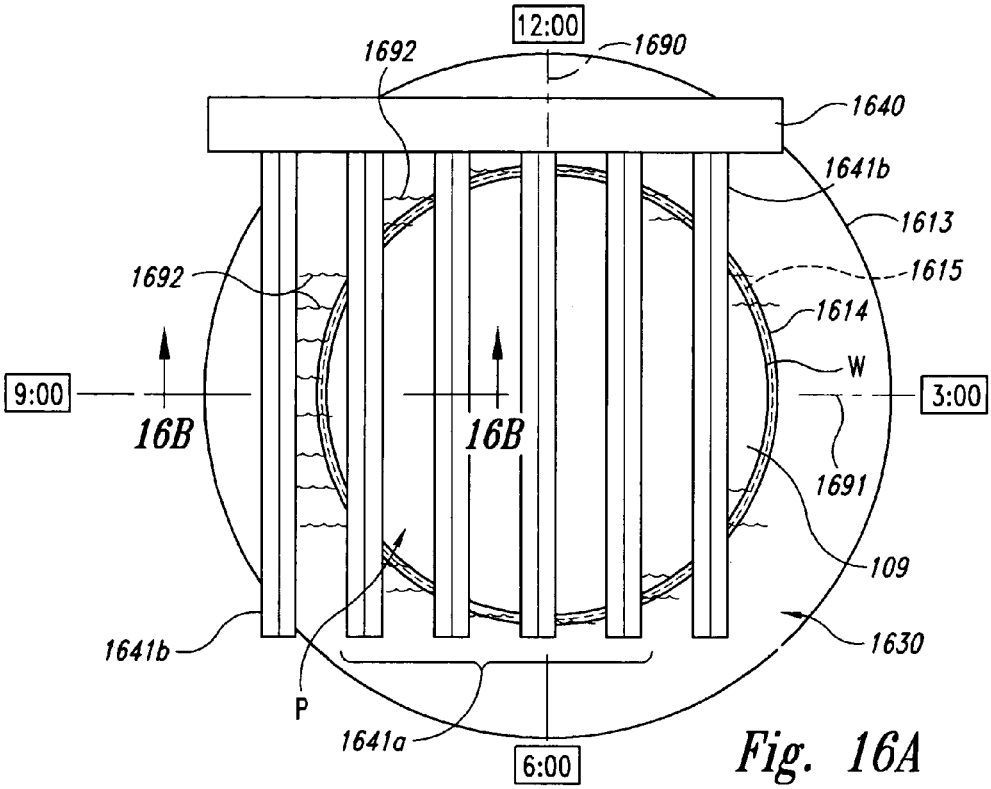
FIGS. 16A-16B illustrate a bottom plan view and a cross-sectional view, respectively, of a portion of a paddle chamber having paddles of different sizes in accordance with yet another embodiment of the invention.
Figure 16B:
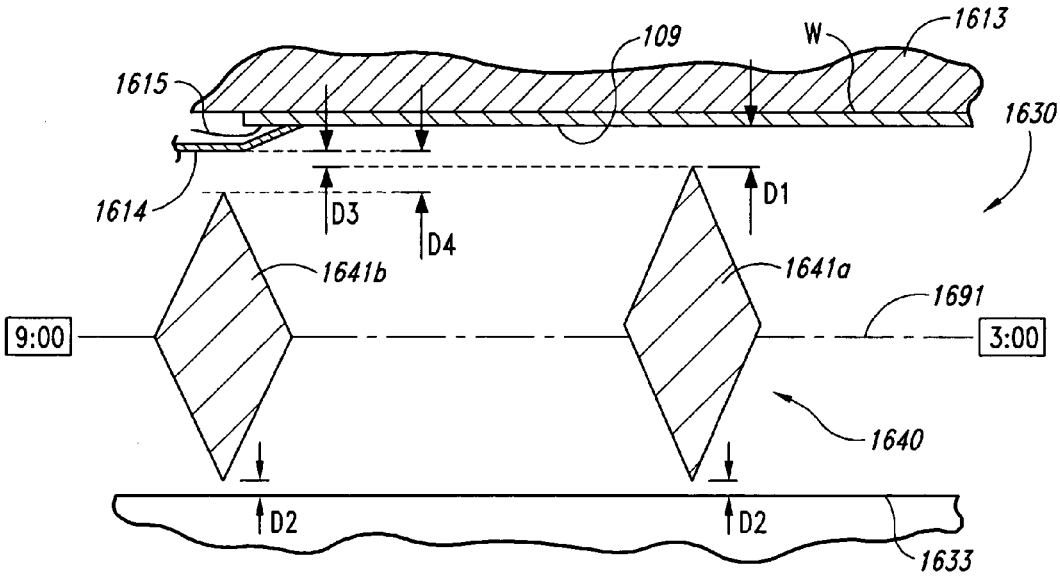

As the linearly elongated paddles 741 described above reciprocate transversely beneath a circular workpiece W, they may tend to create three-dimensional effects in the flow field adjacent to the workpiece W. Embodiments of the invention described below with reference to FIGS. 16A-18 address these effects. For example, FIG. 16A is a partially schematic view looking upwardly at a workpiece W positioned just above a paddle device 1640 housed in a paddle chamber 1630. FIG. 16B is a partially schematic, cross-sectional view of a portion of the workpiece W and the paddle device 1640 shown in FIG. 16A, positioned above a chamber base 1633 of the paddle chamber 1630 and taken substantially along lines 16B-16B of FIG. 16A. As discussed below, the paddle device 1640 includes paddles having different shapes to account for the foregoing three-dimensional effects.

Referring first to FIG. 16A, the paddle device 1640 includes a plurality of paddles 1641 (shown as four inner paddles 1641*a* positioned between two outer paddles 1641*b*). The paddles 1641 are elongated generally parallel to a paddle elongation axis 1690, and reciprocate back and forth along a paddle motion axis 1691, in a manner generally similar to that described above. The workpiece W is carried by a workpiece support 1613 which includes a support seal 1614 extending below and around a periphery of the downwardly facing process surface 109 of the workpiece W to seal an electrical contact assembly 1615.

Because the support seal 1614 projects downwardly away from the process surface 109 of the workpiece W (i.e., outwardly from the plane of FIG. 16A), the paddles 1641 are spaced more closely to the support seal 1614 than to the process surface 109. When the paddles 1641 move back and forth, passing directly beneath the support seal 1614, they can form vortices 1692 and/or high speed jets as flow accelerates through the relatively narrow gap between the paddles 1641 and the support seal 1614. For example, the vortices 1692 can form as the paddles 1641 pass beneath and beyond the support seal 1614, or the vortices 1692 can form when the paddles 1641 become aligned with the support seal 1614 and then pass back over the process surface 109 of the workpiece W. These vortices 1692 may not have a significant impact on the mass transfer at the process surface 109 where the support seal 1614 is generally parallel to the paddle motion axis 1691 (e.g., proximate to the 12:00 and 6:00 positions shown in FIG. 16A), but can have more substantial effects where the support seal 1614 is transverse to the paddle motion axis 1691 (e.g., proximate to the 3:00 and 9:00 positions of FIG. 16A). As discussed in greater detail below with reference to FIG. 16B, the outer agitator elements 1641*b* (aligned with outer regions of the workpiece W and the process location P) can have a different size than the inner agitator elements 1641*a* (aligned with the inner regions of the workpiece W and the process location P) to counteract this effect.

FIG. 16B illustrates the left outer paddle 1641*b* and the left-most inner paddle 1641*a* shown in FIG. 16A. The inner paddle 1641*a* is spaced apart from the workpiece W by a gap distance D1 and from the chamber base 1633 by a gap distance D2. If the inner paddle 1641*a* were to reciprocate back and forth beneath the support seal 1614 at the 9:00 position, significant portions of the inner paddle 1641*a* would be spaced apart from the support seal 1614 by a gap distance D3, which is significantly smaller than the gap distance D1. As discussed above, this can cause vortices 1692 (FIG. 16A) to form, and such vortices can more greatly enhance the mass transfer characteristics at the process surface 109 of the workpiece W at this position than at other positions (e.g., the 12:00 or 6:00 positions). Alternatively, vortices can form across the entire process surface 109, but can be stronger at the 9:00 (and 3:00) positions than at the 12:00 (and 6:00) positions.

To counteract the foregoing effect, the outer paddle 1641*b* has a different (e.g., smaller) size than the inner paddle 1641*a* so as to be spaced apart from the support seal 1614 by a gap distance D4, which is approximately equal to the gap distance D1 between the inner paddle 1641*a* and the workpiece W. Accordingly, the enhanced mass transfer effect at the periphery of the workpiece W (and in particular, at the periphery proximate to the 3:00 and 9:00 positions shown in FIG. 16A) can be at least approximately the same as the enhanced mass transfer effects over the rest of the workpiece W.

Figure 17:
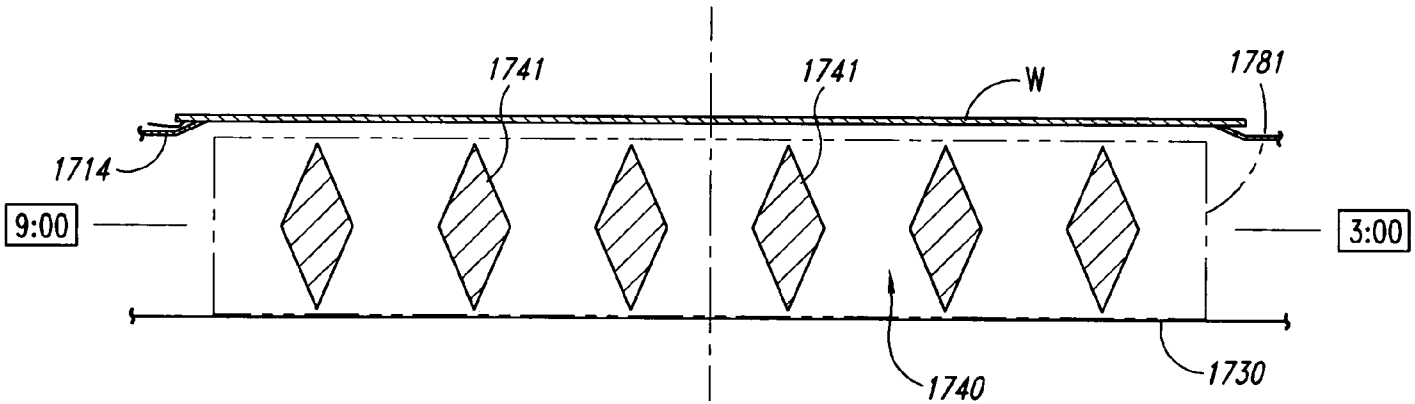
FIG. 17 is a cross-sectional view of a plurality of paddles that reciprocate within an envelope in accordance with another embodiment of the invention.

FIG. 17 is a cross-sectional illustration of a paddle device 1740 positioned in a paddle chamber 1730 in accordance with another embodiment of the invention. The paddle device 1740 includes paddles 1741 configured to move within the paddle chamber 1730 in a manner that also reduces disparities between the mass transfer characteristics at the periphery and the interior of the workpiece W. In particular, the paddles 1741 move back and forth within an envelope 1781 that does not extend over a support seal 1714 proximate to the 3:00 and 9:00 positions. Accordingly, the paddles 1741 are less likely to form vortices (or disparately strong vortices) or other flow field disparities adjacent to the workpiece W proximate to the 3:00 and 6:00 positions.

Figure 18:
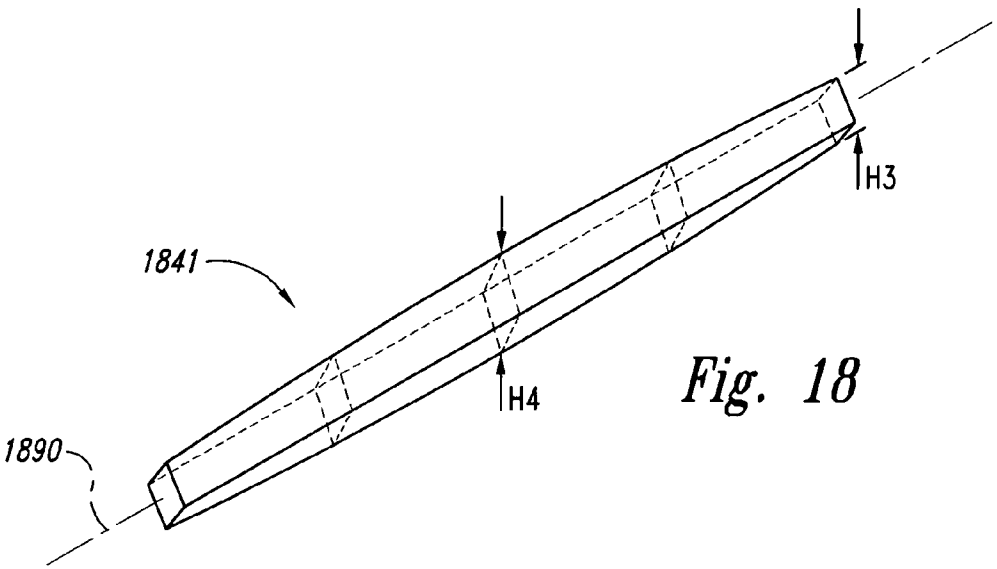
FIG. 18 is a partially schematic, isometric illustration of a paddle having a height that changes over its length.
Figure 19A:
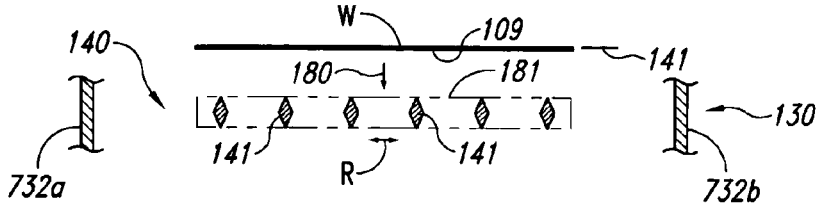
FIGS. 19A-19F schematically illustrate a pattern for shifting the reciprocation stroke of paddles in accordance with an embodiment of the invention.
Figure 19B:
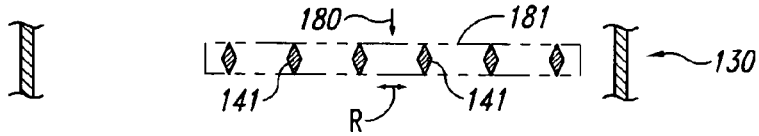
Figure 19C:
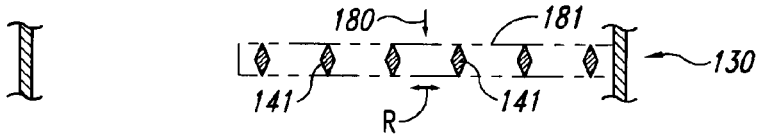
Figure 19D:
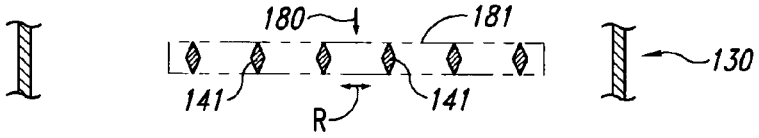
Figure 19E:
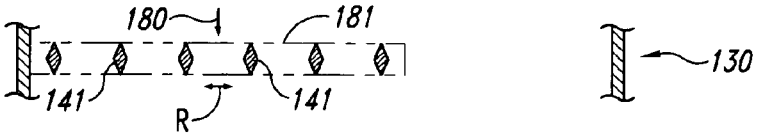
Figure 19F:
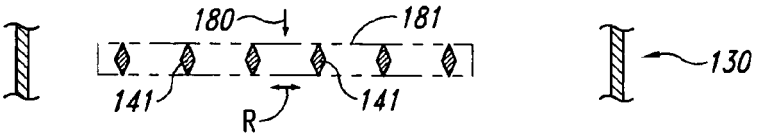

FIG. 18 is an isometric illustration of a paddle 1841 configured in accordance with another embodiment of the invention. The paddle 1841 has a height H3 proximate to its ends, and a height H4 greater than H3 at a position between the ends. More generally, the paddle 1841 can have different cross-sectional shapes and/or sizes at different positions along an elongation axis 1890. In a particular example, the inner paddles 1641*a* described above with reference to FIG. 16A may have a shape generally similar to that of the paddle 1841 shown in FIG. 18, for example, to reduce the likelihood for creating disparately enhanced mass transfer effects proximate to the 12:00 and 6:00 positions shown in FIG. 16A.

Any of the paddle devices described above with reference to FIGS. 6-18 can reciprocate in a changing, repeatable pattern. For example, in one arrangement shown in FIGS. 19A-19F, the paddle device 140 reciprocates one or more times from the central position 180, and then shifts laterally so that the central position 180 for the next reciprocation (or series of reciprocations) is different than for the preceding reciprocation. In a particular embodiment shown in FIGS. 19A-19F, the central position 180 shifts to five points before returning to its original location. At each point, the paddle device 140 reciprocates within an envelope 181 before shifting to the next point. In other particular examples, the central position 181 shifts to from two to twelve or more points. When the central position 181 shifts to twelve points, at each point, the paddle device 140 reciprocates within an envelope 181 that extends from about 15-75 millimeters (and still more particularly, about 30 millimeters) beyond the outermost paddles 141, and the central position 180 shifts by about 15 millimeters from one point to the next. In other arrangements, the central position 180 shifts to other numbers of points before returning to its original location.

Shifting the point about which the paddle device 140 reciprocates reduces the likelihood for forming shadows or other undesirable patterns on the workpiece W. This effect results from at least two factors. First, shifting the central position 180 reduces electric field shadowing created by the physical structure of the paddles 141. Second, shifting the central position 180 can shift the pattern of vortices that may shed from each paddle 141 as it moves. This in turn distributes the vortices (or other flow structures) more uniformly over the process surface 109 of the workpiece W. The paddle device 140 can accelerate and decelerate quickly (for example, at about 8 meters/second$^2$) to further reduce the likelihood for shadowing. Controlling the speed of the paddles 141 will also influence the diffusion layer thickness. For example, increasing the speed of the paddles 141 from 0.2 meters/second to 2.0 meters per second is expected to reduce the diffusion layer thickness by a factor of about 3.

The number of paddles 141 may be selected to reduce the spacing between adjacent paddles 141, and to reduce the minimum stroke length over which each paddle 141 reciprocates. For example, increasing the number of paddles 141 included in the paddle device 140 can reduce the spacing between neighboring paddles 141 and reduce the minimum stroke length for each paddle 141. Each paddle 141 accordingly moves adjacent to only a portion of the workpiece W rather than scanning across the entire diameter of the workpiece W. In a further particular example, the minimum stroke length for each paddle 141 is equal to or greater than the distance between neighboring paddles 141. For any of these arrangements, the increased number of paddles 141 increases the frequency with which any one portion of the workpiece W has a paddle 141 pass by it, without requiring the paddles 141 to travel at extremely high speeds. Reducing the stroke length of the paddles 141 (and therefore, the paddle device 140) also reduces the mechanical complexity of the drive system that moves the paddles 141.

From the foregoing, it will be appreciated that specific embodiments of the invention have been described herein for purposes of illustration, but that various modifications may be made without deviating from the spirit and scope of the invention. For example, features of the paddle devices and paddle chambers described above in the context of electrolytic processing reactors are also applicable to other reactors, including electroless processing reactors. In another example, the workpiece W reciprocates relative to the paddle device. In still a further example, the workpiece W and the paddle device need not move relative to each other. In particular, fluid jets issuing from the paddle device can provide fluid agitation that enhances the mass transfer process. Nevertheless, at least some aspect of the workpiece W and/or the paddle device is activated to provide the fluid agitation and corresponding mass transfer enhancement at the surface of the workpiece W. Accordingly, the invention is not limited except as by the appended claims.

We claim:

1. An integrated tool for wet chemical processing of microfeature workpieces, comprising:

a mounting module comprising a deck having a rigid outer member with a plurality of positioning elements and a plurality of attachment elements, a rigid interior member juxtaposed to the outer member, and bracing between the outer member and the interior member, wherein the outer member, the bracing and the interior member are fixed together to be dimensionally stable;

a wet chemical processing station attached to the deck, the wet chemical processing station having a first interface member engaged with at least a first one of the positioning elements and a fastener engaged with an attachment element, the wet chemical processing station further including a vessel having a process location positioned to receive a microfeature workpiece, the processing station further including a paddle chamber having an opening at the process location to receive a microfeature workpiece, the paddle chamber further having a plurality of sidewall portions extending downwardly away from the process location, and a base portion having a first surface facing toward the process location and a second surface facing opposite from the first surface, with the second surface inclined to have a higher elevation toward a perimeter of the process location than toward a center of the process location, the processing station further having a paddle device positioned in the paddle chamber, the paddle device having at least one paddle and being movable relative to the process location; and a workpiece transport system attached to the mounting module and having a second interface member engaged with at least a second one of the positioning elements, wherein the first and second positioning elements are fixed relative to each other.

2. The tool of claim 1 wherein at least one of the sidewall portions includes a fluid entrance at least proximate to the process location, at least one of the sidewall portions includes a fluid exit at least proximate to the process location, and the at least one paddle is positioned between the fluid entrance and the fluid exit.

3. The tool of claim 1 wherein the deck comprises a plurality of joists.

4. The tool of claim 1 wherein the deck includes a first positioning element and at least some of the attachment elements, and wherein the mounting module further includes a platform having the second positioning element and being fixedly disposed in the tool relative to the deck.

5. The tool of claim 1 wherein the mounting module includes a platform for carrying the transport system, and wherein:

the deck includes a first set of the positioning elements and a first set of the attachment elements;

the platform includes a second set of positioning elements and a second set of attachment elements;

the wet chemical processing station is carried by the deck and includes a plurality of first interface members and a plurality of first fasteners, with the first interface members being engaged with corresponding positioning elements of the first set of positioning elements, and with the first fasteners being engaged with corresponding attachment elements of the first set of attachment elements; and wherein the transport system is carried by the platform and includes a plurality of second interface members and a plurality of second fasteners, with the second interface members being engaged with corresponding positioning elements of the second set of positioning elements, and with the second fasteners being engaged with corresponding attachments elements of the second set of attachment elements.

6. The tool of claim 1 wherein:

the wet chemical processing chamber is a first electrochemical deposition chamber comprising a first vessel, a first workpiece support disposed relative to the first vessel to hold a workpiece in a processing solution, a first cathodic electrode disposed in one of the first vessel or the first workpiece support, and a first anodic electrode disposed in the other of the first vessel or the first workpiece support; and wherein the tool further comprises a second electrochemical deposition chamber comprising a second vessel, a second workpiece support disposed relative to the second vessel to hold a workpiece in a processing solution, a second cathodic electrode disposed in one of the second vessel or the second workpiece support, and a second anodic electrode disposed in the other of the second vessel or the second workpiece support.

7. The tool of claim 1 wherein:

the wet chemical processing chamber is a first electrochemical deposition chamber comprising a first vessel, a first workpiece support disposed relative to the first vessel to hold a workpiece in a processing solution, a first cathodic electrode disposed in one of the first vessel or the first workpiece support, and a first anodic electrode disposed in the other of the first vessel or the first workpiece support; and wherein the tool further includes a second wet chemical processing chamber comprising a cleaning chamber having a fluid delivery system that directs a cleaning fluid onto a workpiece.

8. The tool of claim 1 wherein the mounting module is configured to maintain relative positions between the first and second positioning elements to within approximately 0.005 to 0.015 inch.

9. The tool of claim 1, further comprising a workpiece support carried by the mounting module; and a controller operatively coupled to the at least one of the paddle device and the workpiece support, the controller being configured to move the at least one of the at least one paddle device and the workpiece support relative to the other in a reciprocal manner along a generally linear axis, with a stroke of the relative motion changing between at least two successive reciprocations.

10. The tool of claim 1 wherein the paddle device includes a plurality of paddles having spaced apart paddle surfaces and being reciprocally movable relative to the process location along a generally linear motion axis.

11. The tool of claim 1, further comprising a magnet positioned proximate to the process location to orient material deposited on a microfeature workpiece at the process location.

12. The tool of claim 1 wherein the at least one paddle has a first surface and a second surface facing opposite from the first surface, the first and second surfaces being canted outwardly and downwardly away from an axis positioned between the surfaces and normal to the process location.

13. The tool of claim 1, further comprising a workpiece support positioned to carry a workpiece at the process location, and wherein the at least one paddle is at least partially transmissive to the processing fluid to allow the processing fluid to pass through the at least one paddle as a result of relative motion between the at least one paddle and the workpiece support.

14. The tool of claim 1 wherein the process location includes a portion of a generally planar process plane, and wherein the tool further comprises an electrode support positioned to carry a thieving electrode remote from the process plane.

15. The tool of claim 2, further comprising a workpiece support positioned to carry a workpiece at the process location, and wherein the process location includes a process plane, and wherein the workpiece support is positioned to rotate a microfeature workpiece at the process plane about an axis generally normal to the process plane.

16. The tool of claim 1 wherein the outer member is superimposed over the interior member, and the deck further comprises a plurality of bolts clamping the outer member to one side of the bracing the clamping the interior member to another side of the bracing.

17. The tool of claim 1 wherein the bracing comprises horizontal joists, the outer member comprises a rigid top panel attached to a top side of the joists, the interior member comprises a bottom panel superimposed under the top panel and attached to an underside of the joists, and the deck further comprises a plurality of bolts extending through the bracing to clamp the top panel and the bottom panel to the joists.

18. The tool of claim 1 wherein the top panel, the joists, and the bottom panel are configured to maintain relative positions between the positioning elements across the top panel to within 0.025 inch.

19. The tool of claim 1 wherein the base portion is spaced apart from the process location by a first distance along a first axis generally normal to the process location and wherein the at least one paddle extends for a second distance generally parallel to the first axis, the second distance being at least 70% of the first distance.

20. The tool of claim 1, further comprising:

a magnet positioned at least proximate to the process location, the magnet being positioned to impose a magnetic field at the process location to orient material deposited on a microfeature workpiece; and an electrode support positioned to carry at least one electrode in fluid communication with the process location, the electrode support being movable relative to the vessel between a process position and a removed position along a motion path that does not pass through the process location.

21. The tool of claim 1 wherein the paddle device includes a first paddle and a second paddle, with at least a portion of the second paddle being spaced apart from the first paddle, the first paddle having a first shape and size and the second paddle having a second shape and size, with the first shape being different than the second shape, or the first size being different than the second size, or both.

22. The tool of claim 1, further comprising an electrode support positioned to be in fluid communication with the process location, the electrode support having a plurality of electrode chambers at least partially separated from each other by dielectric barriers, with gaps between the dielectric barriers forming a corresponding plurality of virtual electrode locations spaced apart from the process location.

23. The tool of claim 1, further comprising:

an electrode support configured to carry at least one electrode, the electrode support being in fluid communication with the process location; and an electric field control element positioned along a flow path between the electrode support and the process location, the electric field control element being configured control an electrical current density in the processing fluid at the process location to have a first value at a first circumferential site of the process location and a second value different than the first value at a second circumferential site of the process location.

* * * * *